US008898853B1

(12) United States Patent
Sanders et al.

(10) Patent No.: US 8,898,853 B1
(45) Date of Patent: Dec. 2, 2014

(54) VACUUM CLEANING SYSTEM AND METHOD OF USE

(71) Applicant: Jeffry Sawyer, Abbeville, LA (US)

(72) Inventors: Scott Sanders, Patterson, LA (US); Jeffry Sawyer, Abbeville, LA (US)

(73) Assignee: Diamond Tank Rentals, Inc., Morgan City, LA, CA (US)

( * ) Notice: Subject to any disclaimer, the term of this patent is extended or adjusted under 35 U.S.C. 154(b) by 0 days.

(21) Appl. No.: 13/644,580

(22) Filed: Oct. 4, 2012

Related U.S. Application Data

(63) Continuation of application No. 12/033,184, filed on Feb. 19, 2008, now Pat. No. 8,302,249.

(60) Provisional application No. 60/901,773, filed on Feb. 16, 2007.

(51) Int. Cl.
*A47L 5/38* (2006.01)

(52) U.S. Cl.
USPC ..... 15/301; 15/409; 15/353

(58) Field of Classification Search
USPC ..... 15/301, 302, 246.2, 314, 347, 352, 353, 15/409; 134/21, 18; 138/178
See application file for complete search history.

(56) References Cited

U.S. PATENT DOCUMENTS

| | | | | | |
|---|---|---|---|---|---|
| 3,971,096 | A * | 7/1976 | Renholt | ..... | 15/326 |
| 4,080,104 | A * | 3/1978 | Brown, Jr. | ..... | 417/17 |
| 4,691,407 | A * | 9/1987 | Sloan et al. | ..... | 15/339 |
| 4,947,903 | A * | 8/1990 | Beckwith | ..... | 141/67 |
| 5,378,354 | A * | 1/1995 | Poor | ..... | 210/188 |
| 5,465,455 | A * | 11/1995 | Allen | ..... | 15/319 |
| 6,272,719 | B2 * | 8/2001 | Wu | ..... | 15/353 |
| 6,513,187 | B1 * | 2/2003 | Naseth, Sr. | ..... | 15/314 |
| 6,912,757 | B2 * | 7/2005 | Kaufman et al. | ..... | 15/353 |
| 7,107,646 | B2 * | 9/2006 | Cho | ..... | 15/352 |

* cited by examiner

*Primary Examiner* — Dung Van Nguyen
(74) *Attorney, Agent, or Firm* — Emily L. Gordy; Raymond G. Areaux; Carver, Darden, Koretzky, Tessier Finn, Blossman & Areaux, LLC

(57) ABSTRACT

A vacuum cleaning system which has particular application to the oil-field industry. The system includes a vacuum unit for suctioning material from a surface to recycle, reclaim or cleanup said material. The system also includes a collection and discharge unit operable to automatically discharge, into an open atmosphere, an amount of the suctioned material collected while suctioning continues by the vacuum unit. The automatic discharging cycle of the collection and discharge unit allows drilling fluid to be rapidly vacuumed up and discharged to minimize settlement of debris in the collected material.

18 Claims, 32 Drawing Sheets

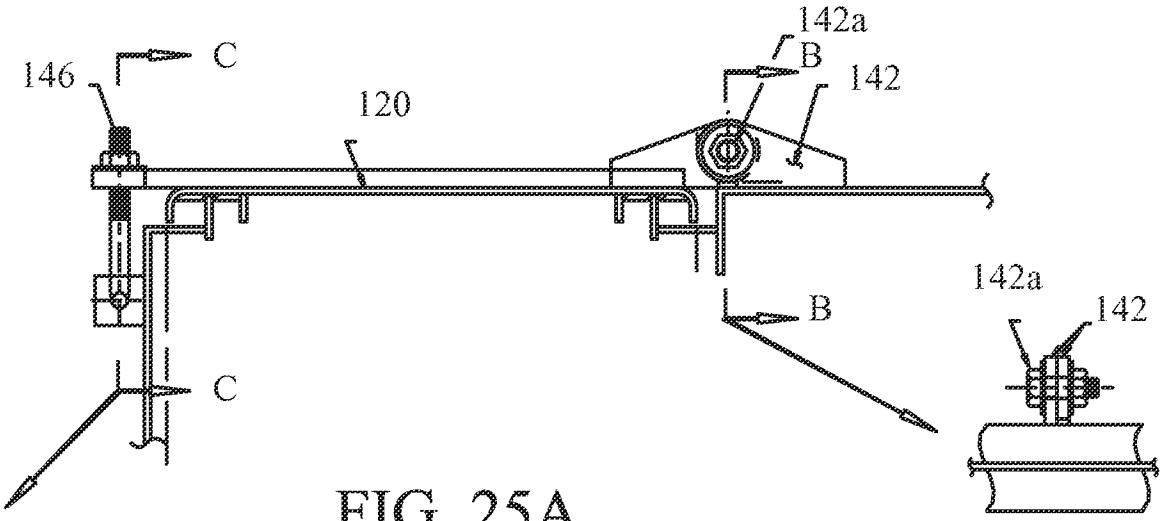
FIG. 25A
FIG. 25B
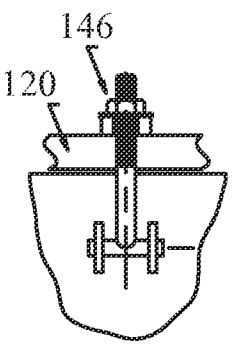
FIG. 25C

VACUUM CLEANING SYSTEM AND METHOD OF USE

COPENDING APPLICATIONS

This application is a continuation of U.S. patent application Ser. No. 12/033,184, filed Feb. 19, 2008, and claims priority benefit of U.S. Provisional Application No. 60/901,773 filed Feb. 16, 2007, and incorporated herein by reference as if set forth in full below.

BACKGROUND OF THE INVENTION

I. Field of the Invention

The present invention relates to vacuum cleaning tools for the oil field industry and, more particularly, to a vacuum cleaning system that is operable to discharge an amount of fluid or material into the open atmosphere while vacuuming takes place.

II. General Background

Cleaning or reclaiming spilled drilling fluid from an oil-field platform entails vacuuming the spilled material which is then held in a storage tank. However, existing systems do not allow vacuuming or suctioning to take place while discharging to the open atmosphere and as the storage tank is emptied or discharged. Thus, personnel will wait until the tank is full to empty out the storage tank.

Using current vacuuming systems, personnel will vacuum, wait, vacuum, so on and so forth until the storage tank is essentially full. Then, the drilling fluid in the storage tank is discharged. However, the drilling fluid oftentimes is dense and full of settlement and debris as the result of drilling and/or exploration operations. Thus, emptying the tank is cumbersome and time consuming as the tank's filter is unclogged. Accordingly, time is wasted to repeatedly unclog these filters.

Drilling fluid is expensive and can be reclaimed. Furthermore, if a spill takes place, the drilling fluid needs to be cleaned from the platform floor.

Another disadvantage of known vacuum cleaning systems is that these systems require laborers to monitor and judge the fluid level in the storage tank. At such time a valve is switched to allow the tank's contents to be discharged or emptied. Both the monitoring, judging and the need for switching of a valve are subject to human error and failure.

There is a continuing need for a vacuum cleaning system that minimizes settlement and filter clogging as well as expedites the discharging process to discharge into the open atmosphere or storage tank.

As will be seen more fully below, the present invention is substantially different in structure, methodology and approach from that of other vacuum cleaning systems.

SUMMARY OF THE PRESENT INVENTION

The preferred embodiment of vacuum cleaning system of the present invention solves the aforementioned problems in a straight forward and simple manner.

An aspect of the present invention includes a vacuum cleaning system comprising a vacuum unit for suctioning material from a surface. The system also includes a collection and discharge unit operable to automatically discharge an amount of the suctioned material collected while suctioning continues by the vacuum unit, said discharge being made into an open atmosphere.

A further aspect of the present invention includes a method of vacuuming comprising the steps of: suctioning material from a surface by a vacuum unit; and collecting an amount of the suctioned material in a remote collection and discharge unit. After the amount is collected, the method further includes discharging automatically the amount of the suctioned material into open atmosphere during the suctioning step.

A still further aspect of the present invention includes a collection and discharge unit comprising a primary collection tank operable to communicate a stream of suctioning force therethrough and collect suctioned material communicated with the suctioning force. The collection and discharge unit also includes a discharge tank operable to automatically discharge an amount of the suctioned material from the primary collection tank, after a fill cycle, into an open atmosphere while communication of the suctioning force and collection of the suction material continues and to automatically repeat the discharge after each subsequent fill cycle.

The above and other objects and features of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals.

FIG. 25A illustrates a cross-sectional view along the plane A-A of FIG. 21.

FIG. 25B illustrates a cross-sectional view along the plane B-B of FIG. 25A.

FIG. 25C illustrates a cross-sectional view along the plane C-C of FIG. 25A.

DETAILED DESCRIPTION OF THE PREFERRED EMBODIMENT

Figure 1:
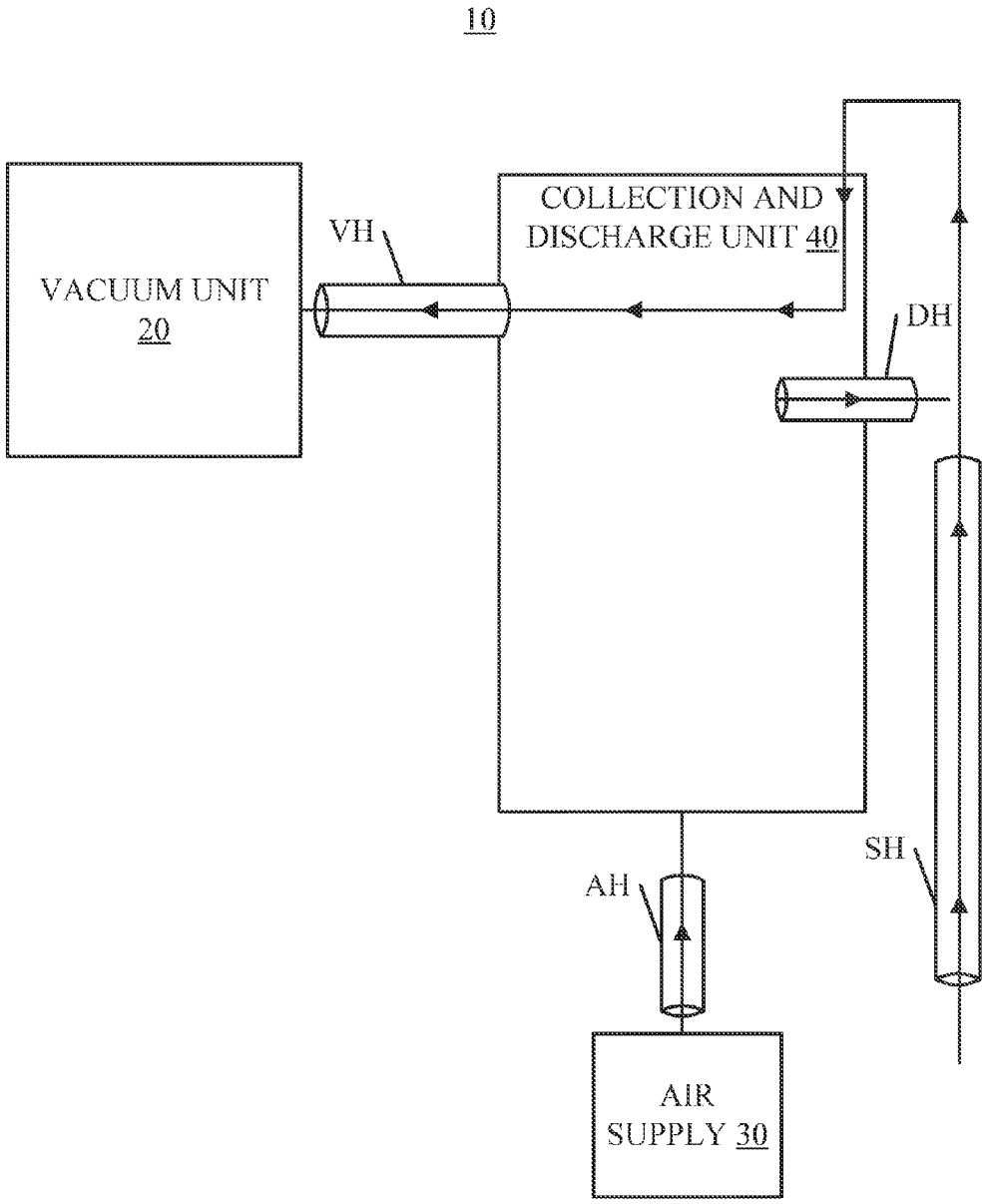
FIG. 1 illustrates a general block diagram of the vacuum cleaning system in accordance with the present invention.
Figure 7:
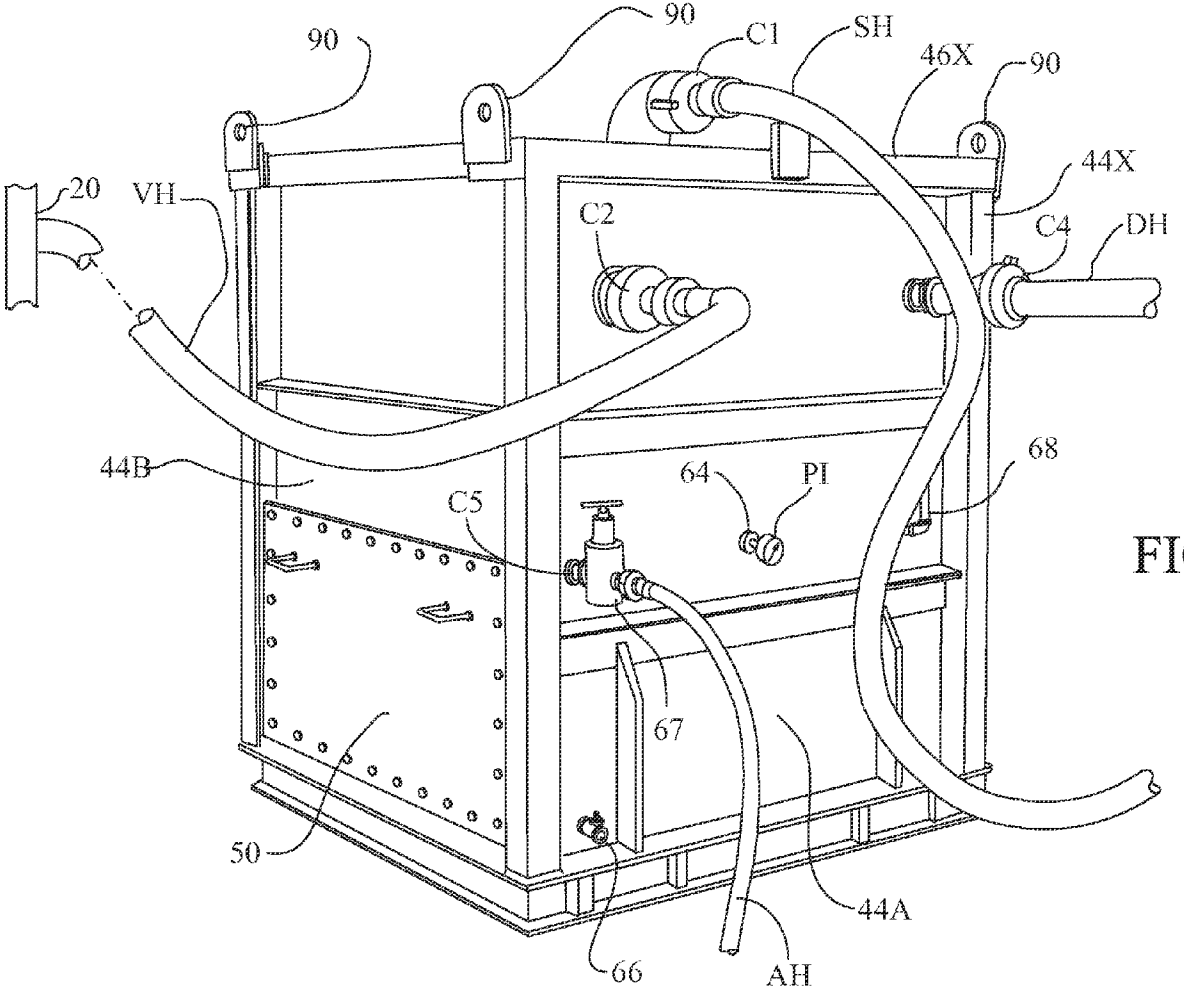
FIG. 7 illustrates a perspective view of the collection and discharge unit with the vacuum hose, air hose, discharge hose and suction hose coupled thereto.
Figure 8:
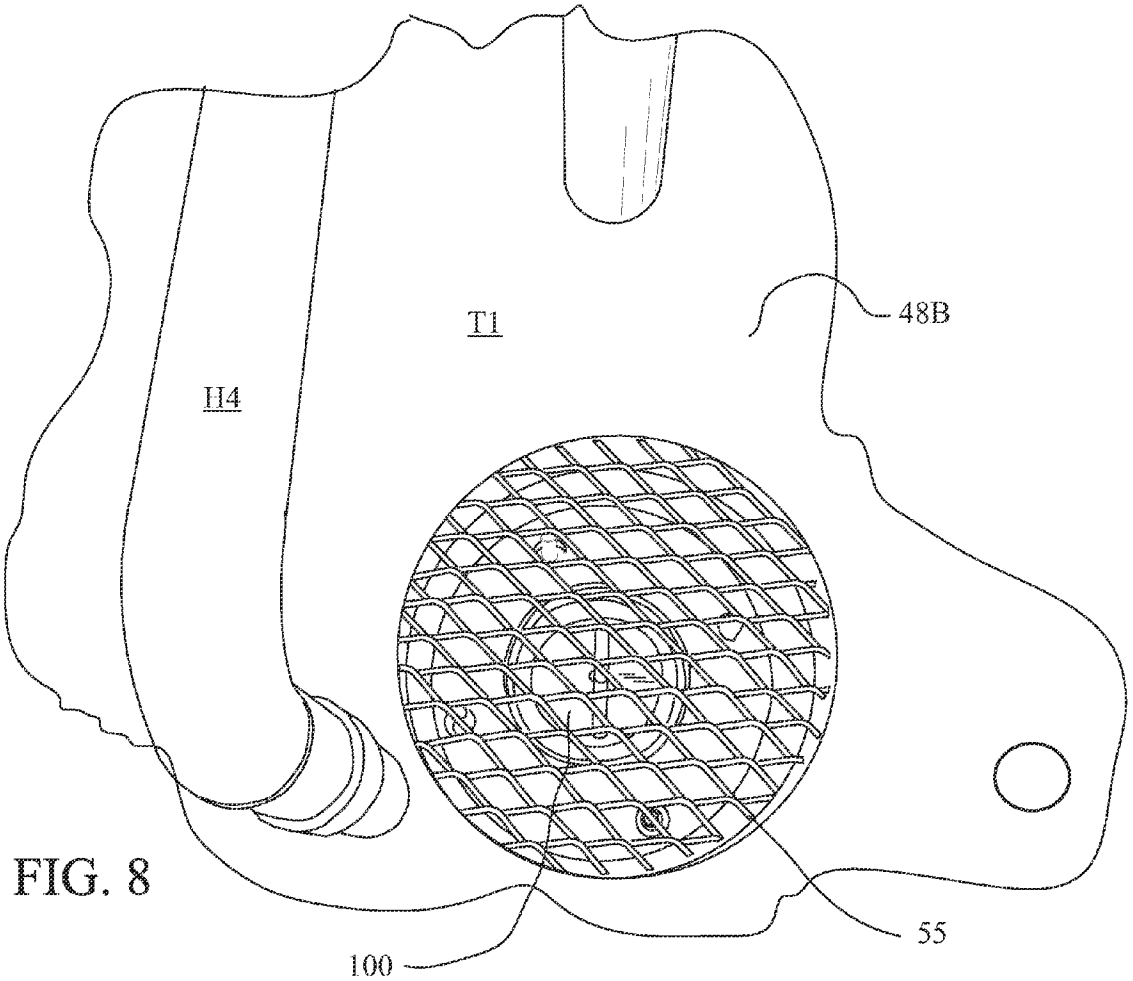
FIG. 8 illustrates a top interior view (partial) of the primary collection tank.

Referring now to the drawings and in particular FIGS. 1 and 7, the vacuum cleaning system of the present invention will generally be referenced by the numeral 10. The vacuum cleaning system 10 includes, in general, a vacuum unit 20 for suctioning material from a surface and a collection and discharge unit 40 operable to collect and discharge an amount of the suctioned material while suctioning continues through a suctioning hose SH by the vacuum unit 20. The vacuum unit 20 is adapted to be in continuous vacuum communication with the collection and discharge unit 40 via a vacuum hose VH. The vacuum cleaning system 10 further includes an air supply source 30 connected to the collection and discharge unit 40 via an air hose AH. The arrow through the air hose AH denotes the direction of the communication of air.

As be seen in FIG. 1, the suctioning pressure generated by vacuum unit 20 is communicated from the vacuum unit 20 through the collection and discharge unit 40 and to the suctioning hose SH. The direction of the arrows in FIG. 1 denotes the direction of the suctioning pressure, but not necessarily the complete path. The vacuum unit 20 may be a positive displacement blower-type vacuum unit. By way of example, the vacuum unit 20 may be a no-load unit with 30 Horse power. However, the vacuum unit 20 may be smaller or larger. In some applications, a 125 Horse power vacuum unit may be suitable.

The blower of the vacuum unit 20 may be a rotary lobe blower such as manufactured by Roots having Model No. URAI68. On the other hand, the blower may be a liquid ring blower or other type of blower. The vacuum unit 20, depending on application, may be required to move 600 to 2500 cubic feet per minute (CFM). Thus, the size of the vacuum unit 20 will depend on the application. By way of example, a 30 Horse power vacuum unit 20 using a rotary lobe blower yields 700 CFM, a 75 Horse power yields 1400 CFM and a 125 Horse power yields 2600 CFM. On the other hand, a liquid ring blower with 100 Horse power yields 1000 CFM.

Figure 2A:
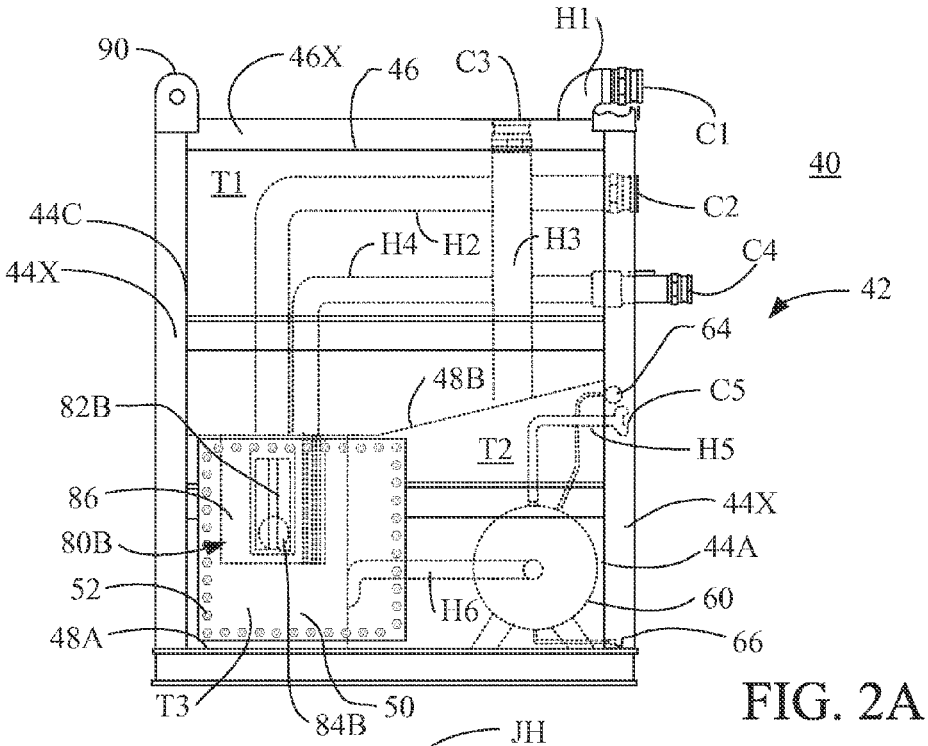
FIGS. 2A and 2B illustrate side views of the collection and discharge unit.
Figure 2B:
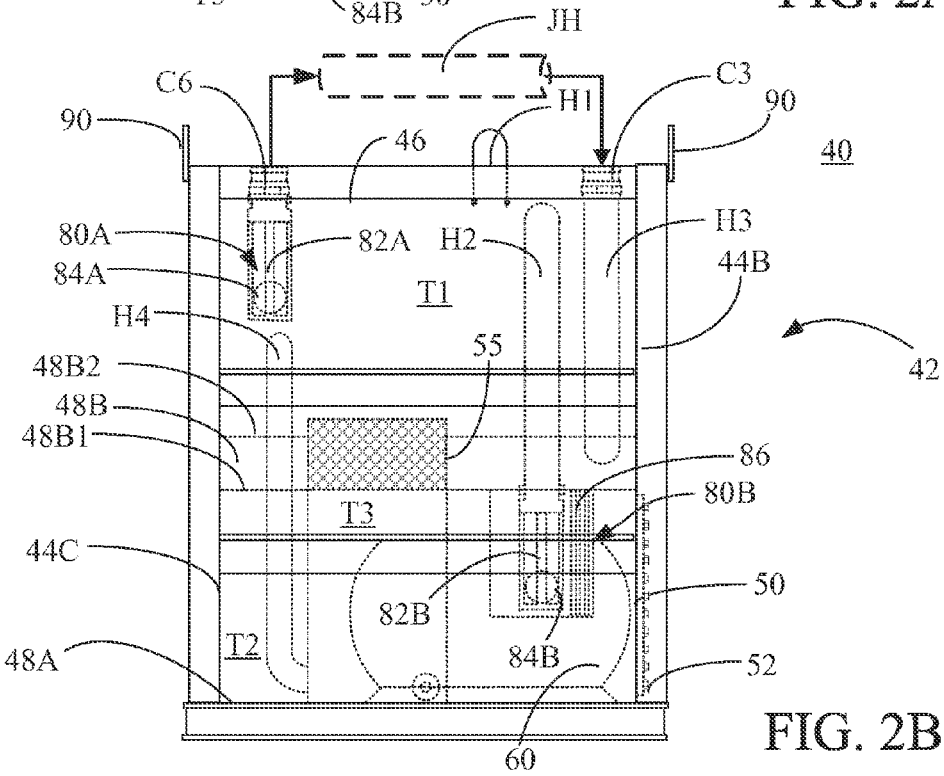
Figure 2C:
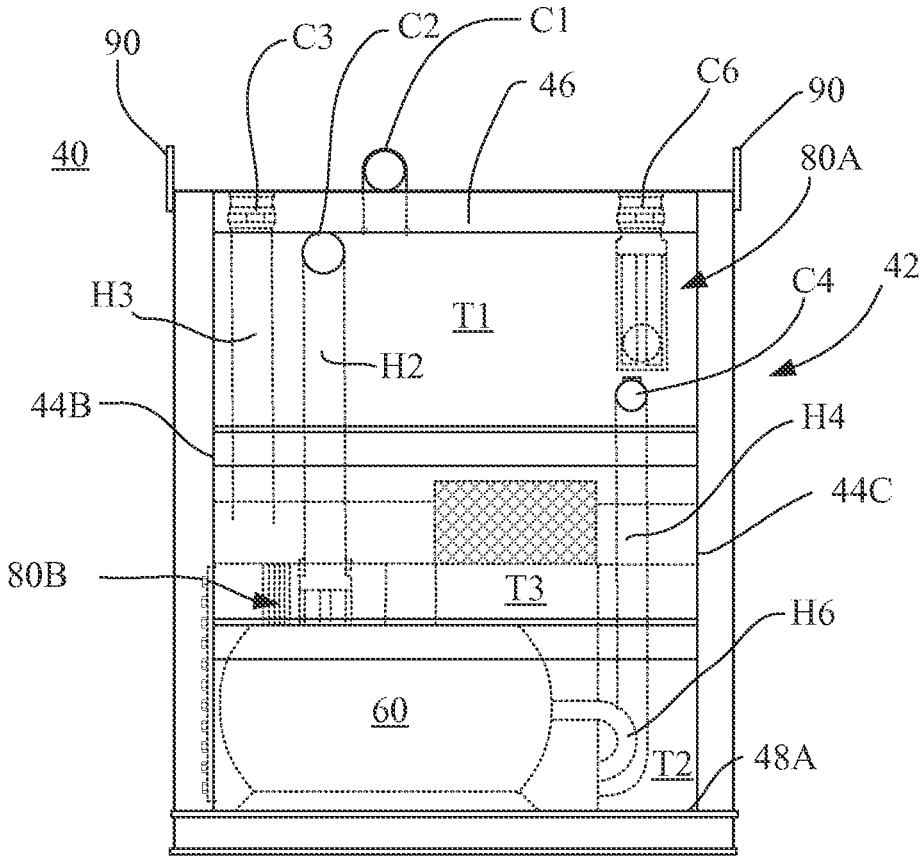
FIG. 2C illustrates a further side view of the collection and discharge unit.
Figure 20:
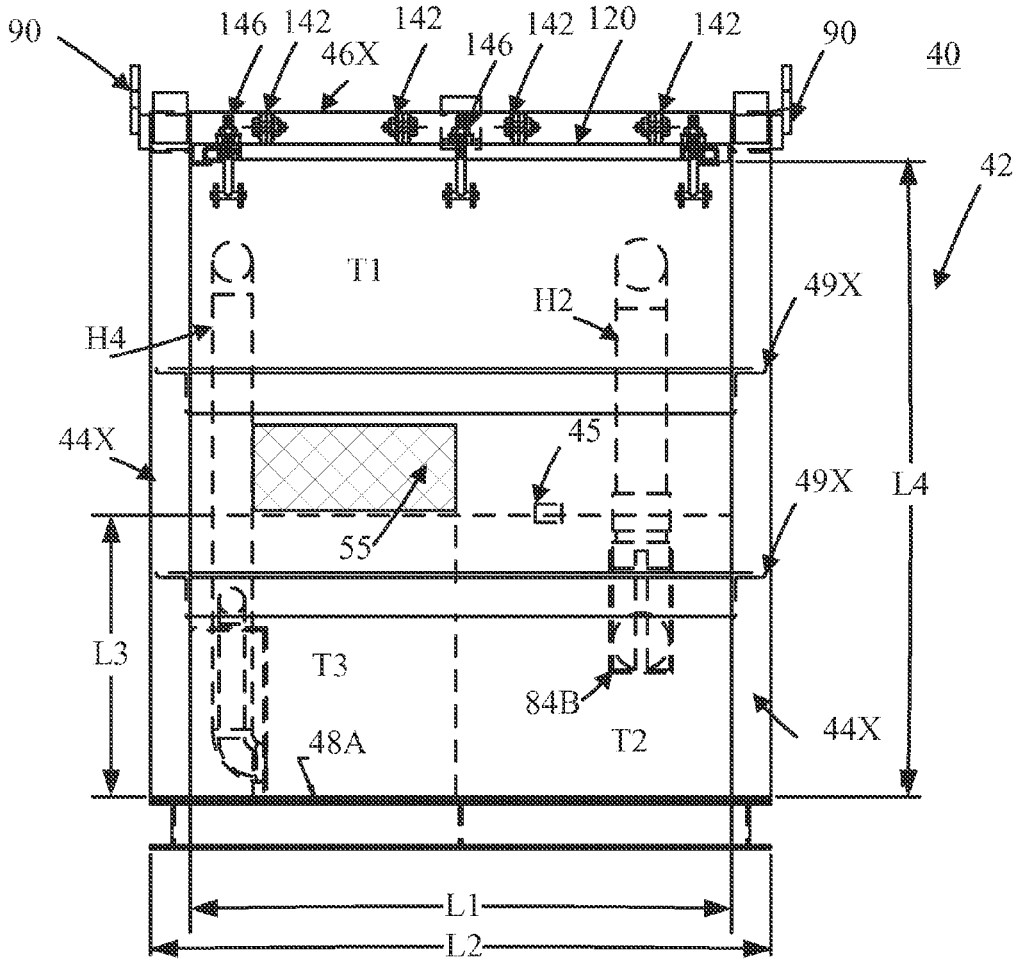
FIG. 20 illustrates a side elevation of the collection and discharge unit of the vacuum cleaning system.
Figure 21:
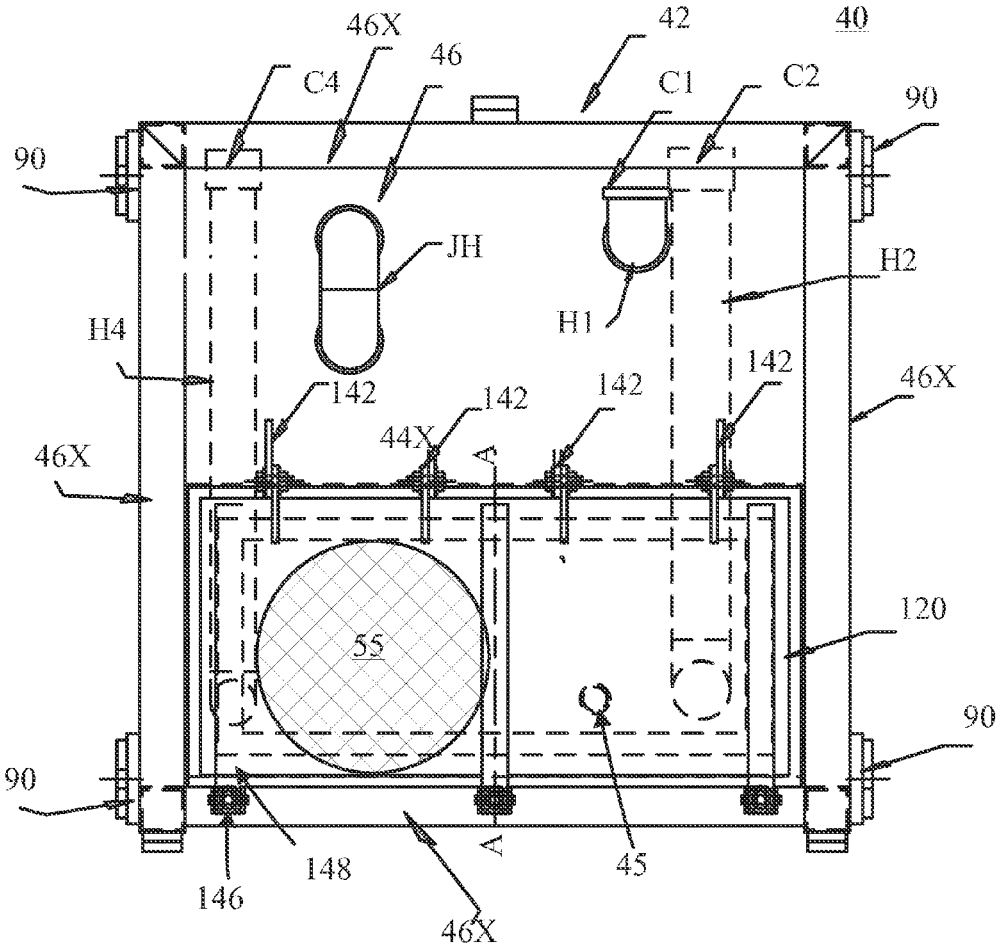
FIG. 21 illustrates a top plan view of the collection and discharge unit of the vacuum cleaning system.
Figure 23:
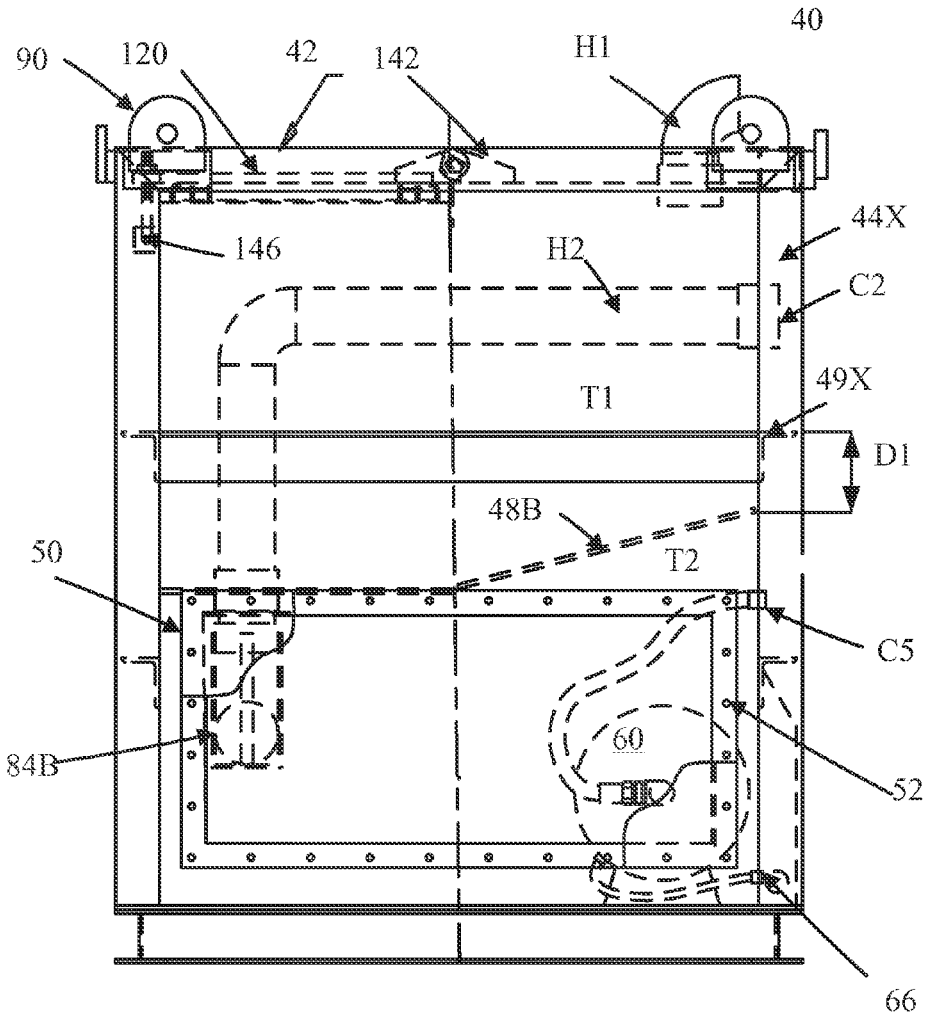
FIG. 23 illustrates a second side elevation of the collection and discharge unit of the vacuum cleaning system.
Figure 24:
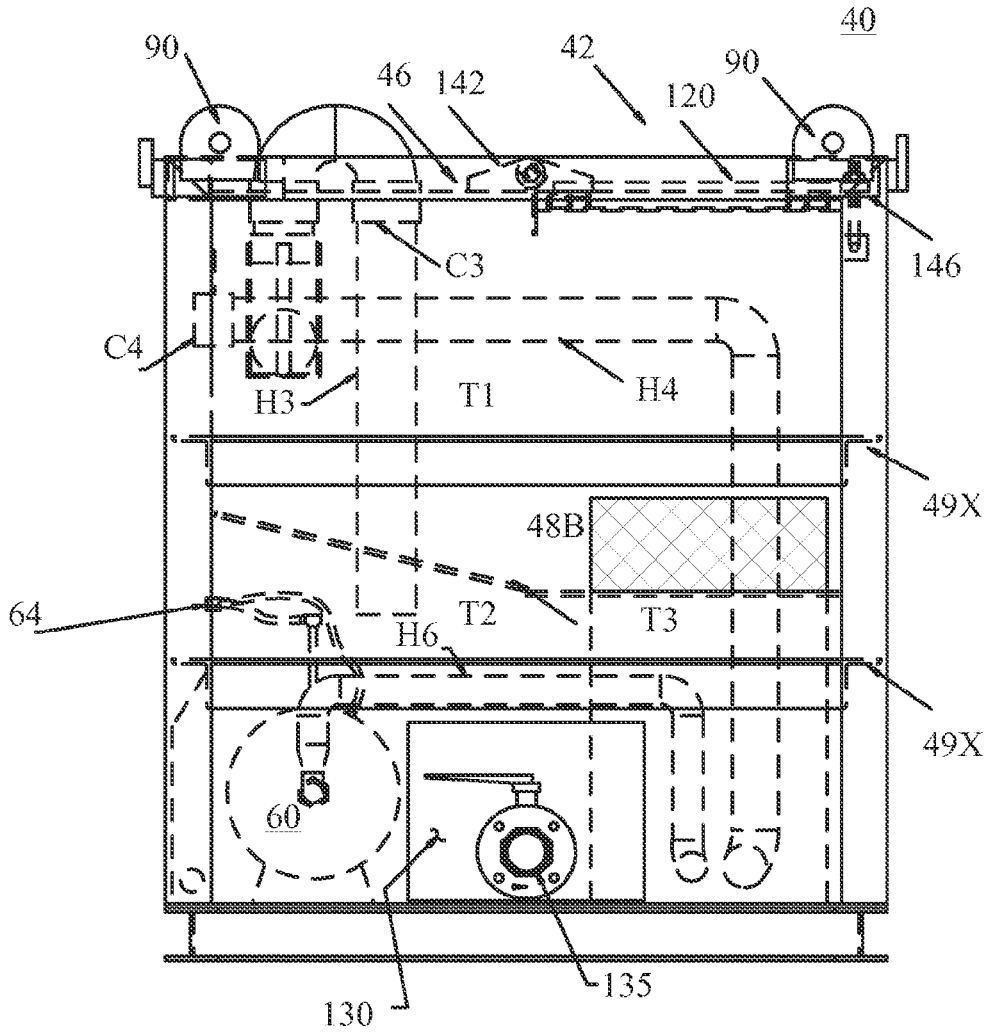
FIG. 24 illustrates a side elevation of the collection and discharge unit of the vacuum cleaning system.
Figure 26:
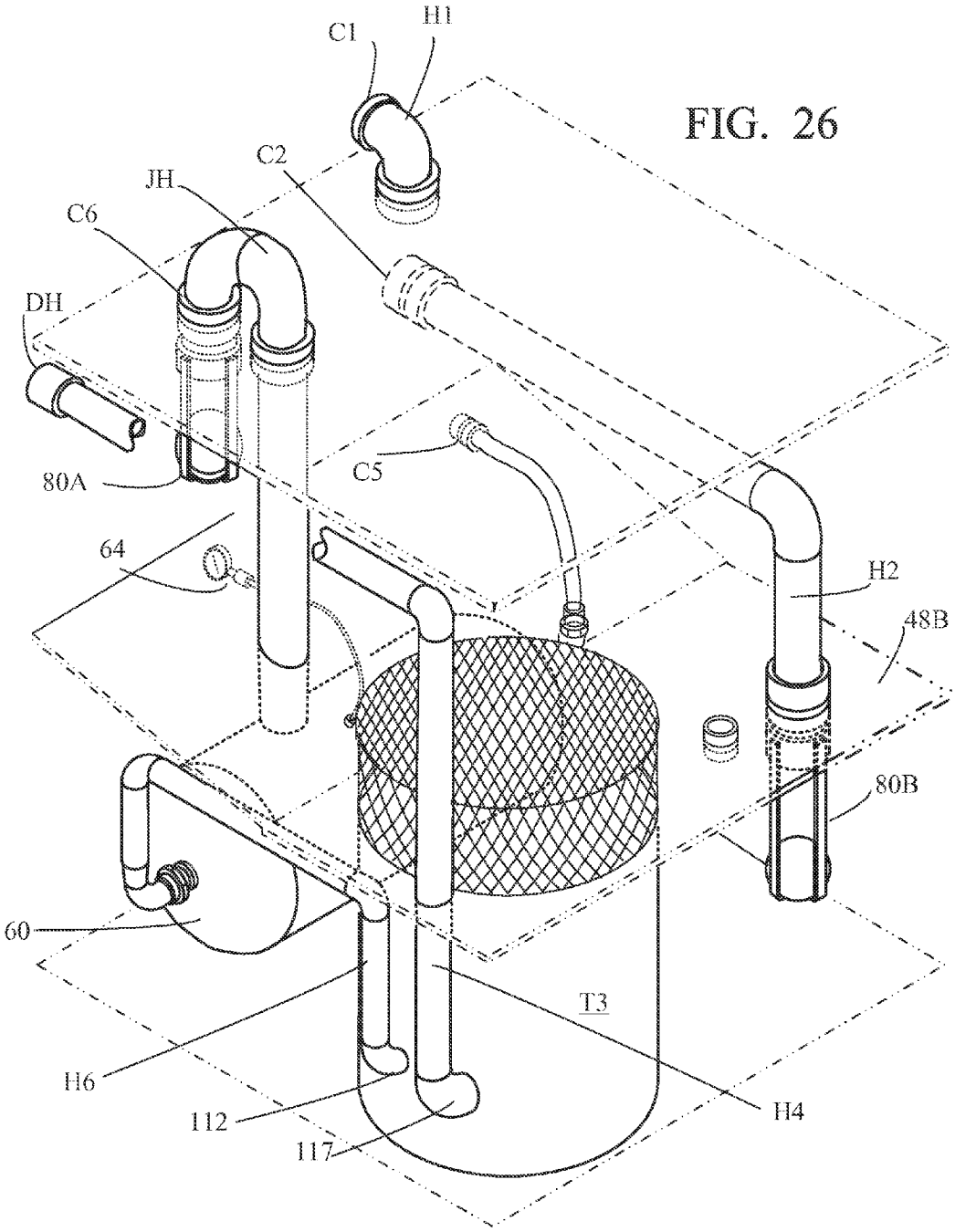
FIG. 26 illustrates a plan view of the collection and discharge unit with the side walls removed.

FIGS. 2A, 2B and 2C illustrate side views of the collection and discharge unit 40. In a more specific illustration, FIGS. 20, 23 and 24 illustrate side views of the collection and discharge unit 40. The housing 42 of the collection and discharge unit 40 is constructed with vertically stacked collection tanks T1, T2 and T3. The primary collection tank T1 lies in a plane above the discharge tank T3. The system 10 is also built with a reserve collection tank T2. The reserve collection tank T2 lies below the primary collection tank T1. In the exemplary embodiment, the discharge tank T3 is positioned within the area below the primary collection tank T1. Hence, the reserve collection tank T2 includes any available space below the sub-floor 48B (FIG. 2A).

The housing 42 includes a plurality of side walls 44A, 44B, 44C and 44D (FIG. 19), wherein side wall 44A is denoted as a front wall. Each of the corners of the housing 42 include a vertical support member 44*x* which protrudes from the surface of the plurality of side walls 44A, 44B, 44C and 44D. Thus, the plurality of side walls 44A, 44B, 44C and 44D are generally recessed. As best seen in FIGS. 2A and 2B, the vertical support members 44*x* are square tubes and may protect the connectors C2, C5, or other fixtures protruding from the plurality of side walls 44A, 44B, 44C and 44D. The housing 42 also includes a top wall 46 and a base 48A.

The four edges of the top wall 46 include horizontal support members 46*x*. The horizontal support members 46*x* extends above the plane of the top wall 46 and may be a square tube. Thus, the top wall 46 is recessed. Like the vertical support members 44*x*, the horizontal support members 46*x* protect connectors C3, C6, etc. protruding from the top wall 46. The plurality of side walls 44A, 44B, 44C and 44D include one or more secondary horizontal support members 49X (FIGS. 20, 23 and 24) which extend horizontally between two adjacent side walls. The distance D1 in FIG. 23 is 6½ inches.

With reference to FIG. 20, in the exemplary embodiment, the tank T3 has a height L3 of approximately 2 ft. 1 inch. The overall height L4 (measured between the floor of the base 48A and top wall 46) is approximately 4 ft. The width L1 of the housing 42 between side walls is approximately 4 ft. The distance L2 from end to end of two adjacent vertical support members 44X is approximately 4 ft. 7 inches.

With reference to FIGS. 19, 21 and 25A-C, the top wall 46 of the housing 42 includes a hinged top lid 120. The hinged top lid 120 is shown in an open position in FIG. 19. The hinged top lid 120, when open, provides access to the primary collection tank T1. The hinged top lid 120 includes a plurality of hinge members 142 along a hinged end. The hinge members 142 are fastened to the top wall 46 via fasteners 142*a*. The unhinged end of the lid opposite the hinged end includes a plurality of tie-down fasteners 146. In the exemplary embodiment, the lid 120 is approximately 1 ft. 9 inches by 3 ft. 9⁄16 inches. The lid 120 also includes cross supports 148 extending from or aligned with the tie-down fasteners 146.

Figure 22:
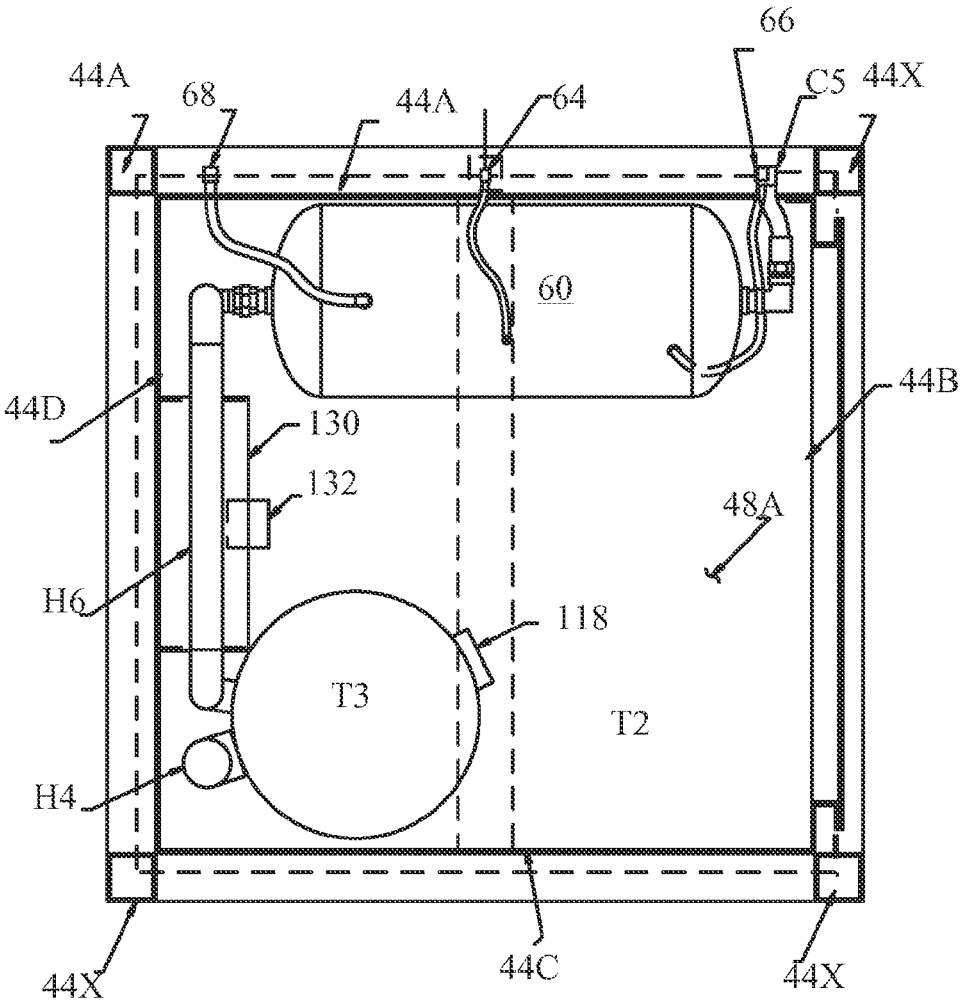
FIG. 22 illustrates a plan view of the reserve collection tank of the vacuum cleaning system.

The housing 42 also includes a side door 50 which provides access to the reserve collection tank T2. Since the discharge tank T3 is in the reserve collection tank T2, the door 50 also provides access to the discharge tank T3. The door 50 is shown fastened to side wall 44B via a plurality of fasteners 52. By way of example, the fasteners 52 are nuts screwed onto a plurality of spaced bolts fixed to the door 50. A gasket may be provided between the door 50 and the tank's side wall. FIG. 22 illustrates a plan view of the reserve collection tank T2.

The top side of the housing 42 has coupled thereto eyelet pads 90. The eyelet pads 90 allow for coupling thereto a lifting sling, chains, straps or other means to lift and transport the housing 42 on and off or about an oil-field platform or other industrial site. The housing 42 is constructed and arranged to be compact and allows the collection and discharge unit 40 to be moved (position and re-position) about the oil-field platform or other industrial site.

FIGS. 2A, 2B, 20-24 and 26 provide an internal view of the collection and discharge unit 40. With reference also to FIGS. 1 and 7, the suction hose SH, through which spilled material 5 is suctioned or vacuumed up into the primary collection tank T1, is coupled to the collection and discharge unit 40 at connector C1. Connector C1 is shown entering into the primary collection tank T1 through the top wall 46 via conduit H1. The vacuuming unit 20 is coupled to the collection and discharge unit 40 at connector C2 in the front side wall 44A via vacuuming hose VH. Connector C2 is shown entering into the primary collection tank T1 through the front side wall 44A. The connector C2 also connects to an internal conduit H2. The internal conduit H2 is channeled to the reserve collection tank T2.

An air tank 60 is positioned below the primary collection tank T1. In the exemplary embodiment, the air tank 60 is positioned in the reserve collection tank T2 in proximity to the discharge tank T3. The air tank 60 is coupled to the discharge tank T3 via conduit H6 to communicate air, under pressure, thereto. By way of example, the air tank 60 communicates air to the discharge tank T3 at 80 lbs of pressure or PSI. The amount of pressure in the air tank 60 may be monitored externally by gauge 64 coupled to the front side wall 44A. Furthermore, the air tank 60 receives air from an external air supply source 30 via the air hose AH. The air hose AH connects to the front side wall 44A via connector C5. The connector C5 communicates air through internal conduit H5 to the air tank 60.

A valve 66 coupled to the air tank 60 is provided in the front side wall 44A. The valve 66 allows air to be removed from the air tank 60 if necessary or to empty the air tank 60 when needed.

FIG. 7 illustrates an exemplary arrangement of the connector C5, the gauge 64 and the valve 66. The valve 66 is a bleed-off valve to drain air from the air tank 60. A pop-off valve 68 (FIG. 22) is also coupled to the air tank 60. The pop-off valve 68 provides a safety feature which prevents the pressure in the air tank from exceeding a predetermined limit. Once the limit is reached or exceeded, the pop-off valve 68 automatically pops off to let air escape from the air tank 60 and reduce the pressure.

The discharge tank T3 discharges an amount of material or fluid filled therein through internal conduit H4 coupled to connector C4. In the exemplary embodiment, while the discharge tank T3 is below the primary collection tank T1, the conduit H4 extends into the primary collection tank and out to the connector C4. At the connector C4, a discharge hose DH is coupled thereto to allow the contents being discharged to be expelled into the open atmosphere.

Figure 3B:
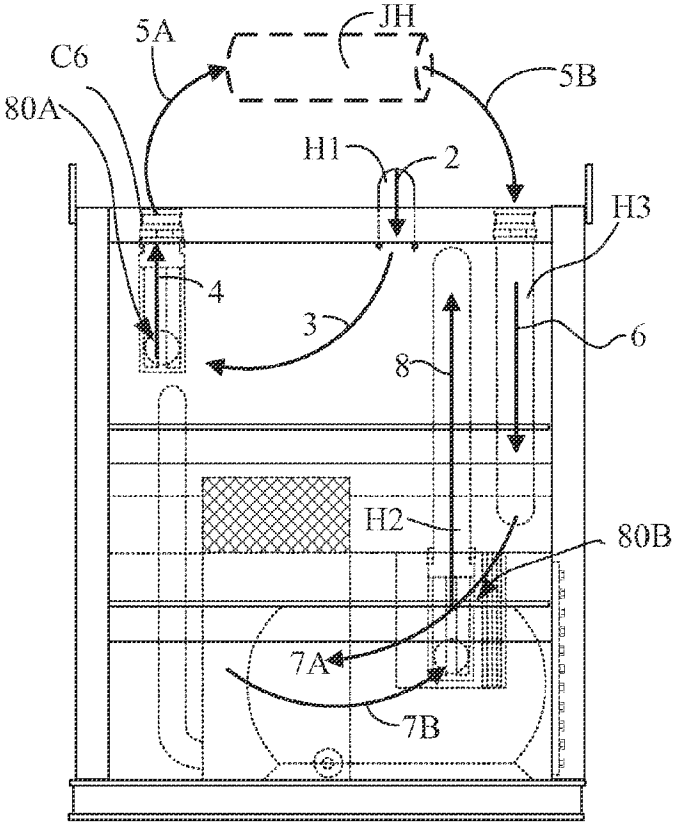
FIGS. 3A and 3B illustrate the side views of the collection and discharge unit of FIGS. 2A and 2B with arrows depicting the vacuum air flow stream.
Figure 3A:
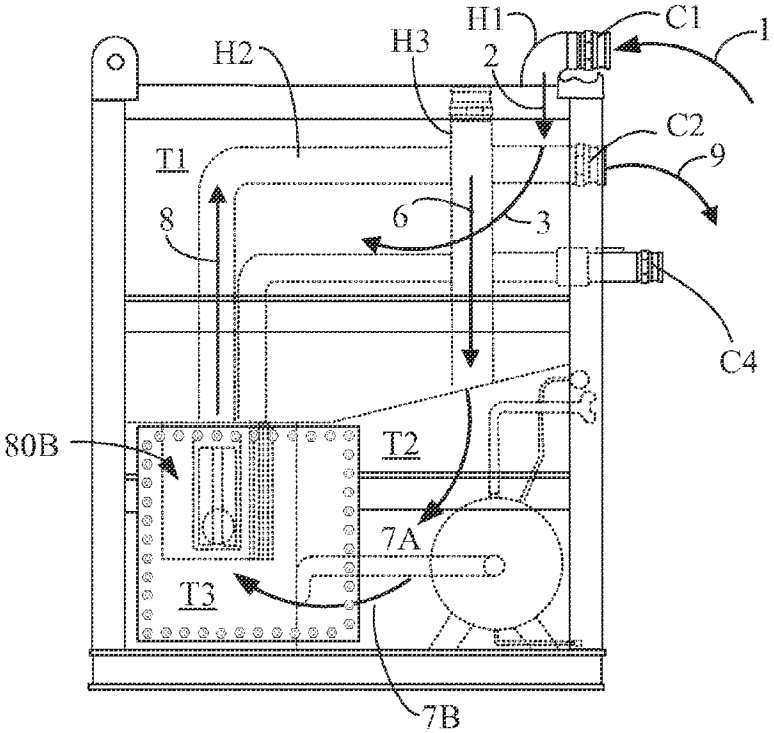

FIGS. 3A and 3B illustrate the side views of the collection and discharge unit of FIGS. 2A and 2B with arrows depicting the vacuum air flow stream. Beginning with FIG. 3A, the arrow 1 depicts the flow of material or fluid 5 being suctioned. The vacuum unit 20, in the direction of arrow 1, draws external air from the atmosphere with the spilled material or fluid 5 via the suctioning or vacuuming pressure created by said vacuum unit 20. The air entering conduit H1 via connector C1 is denoted by arrow 2. The air and material or fluid 5 enters the primary collection tank T1 denoted by arrow 3. In FIG. 2B, the lines labeled 48B1 and 48B2 depict the beginning elevation and ending elevation of the sub-floor 48B. The sub-floor 48B includes a drain 45 (see FIGS. 20 and 21).

With specific reference also to FIG. 2B, the air entering the primary collection tank T1 is suctioned out of the primary collection tank T1 through connection C6 via the internal safety shut-off 80A, depicted by arrow 4. The air exiting the connection C6 is depicted by arrow 5A. The air is then channeled to connection C3 via an external conduit JH and into conduit H3 denoted by arrow 5B. Conduit H3 extends through the primary collection tank T1 and sub-floor 48B and into the reserve collection tank T2. The air entering the reserve collection tank T2 is denoted by arrow 7A. The air in the reserve collection tank T2 is suctioned out of the reserve collection tank T2 though the second internal safety shut-off 80B depicted by arrow 7B. The air exiting the primary reserve tank T2 is communicated through conduit H2 denoted by arrow 8 and out through connector C2 denoted by arrow 9. The air channeled through connector C2, as denoted by arrow 9, is communicated to the vacuum unit 20 via the vacuum hose VH. The above description completes the flow of suctioned air through the system 10 during continuous operations by the vacuum unit 20, unless the vacuum unit 20 is turned off.

Figure 4A:
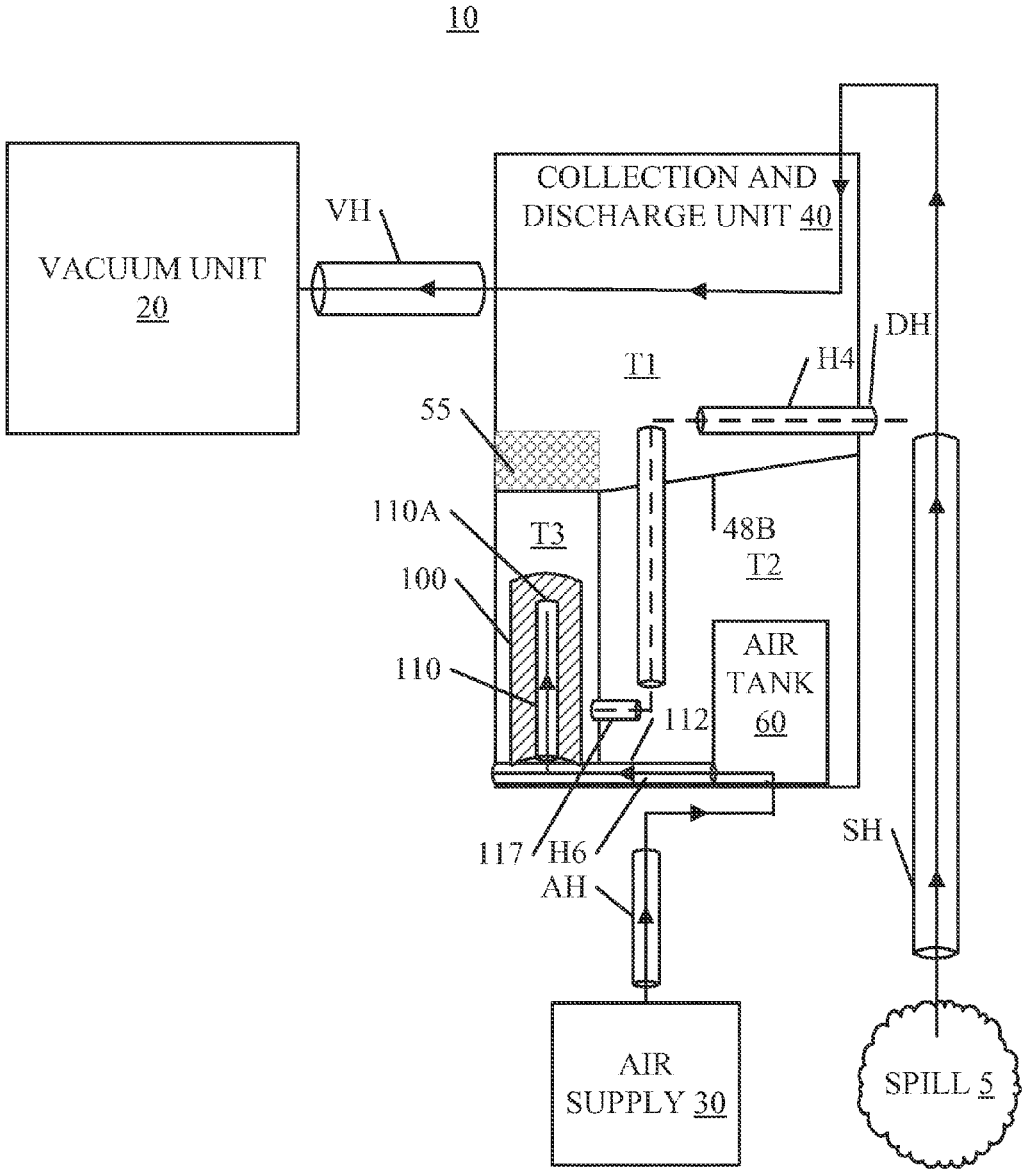
FIG. 4A illustrates a general block diagram of the vacuum cleaning system with a partial view of the discharge control plunger in a non-discharge position to begin a fill cycle.
Figure 14A:
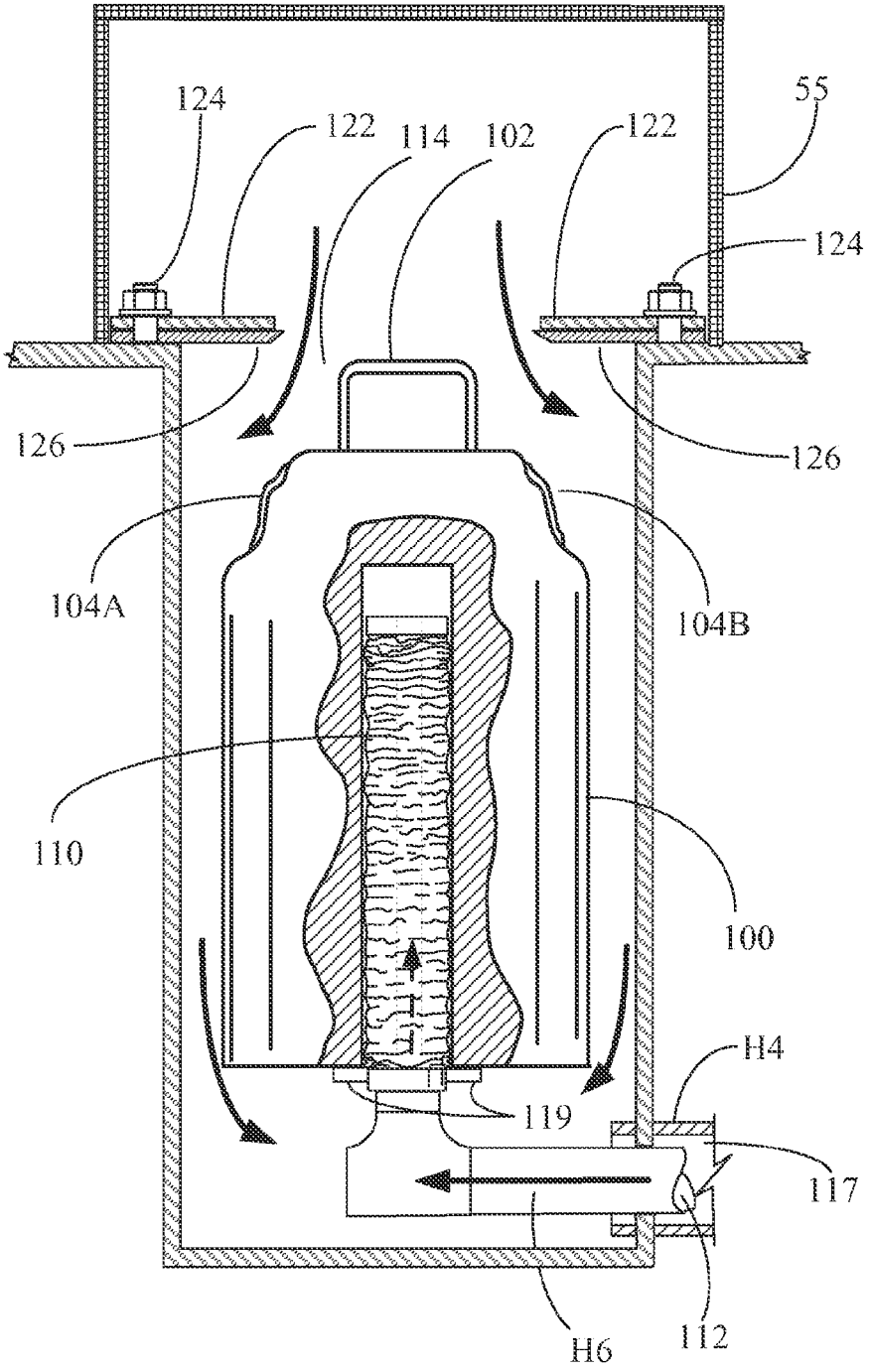
FIGS. 14A-14C illustrate the positions of discharge control plunger at the beginning of a fill cycle to the end of the fill cycle.
Figure 14B:
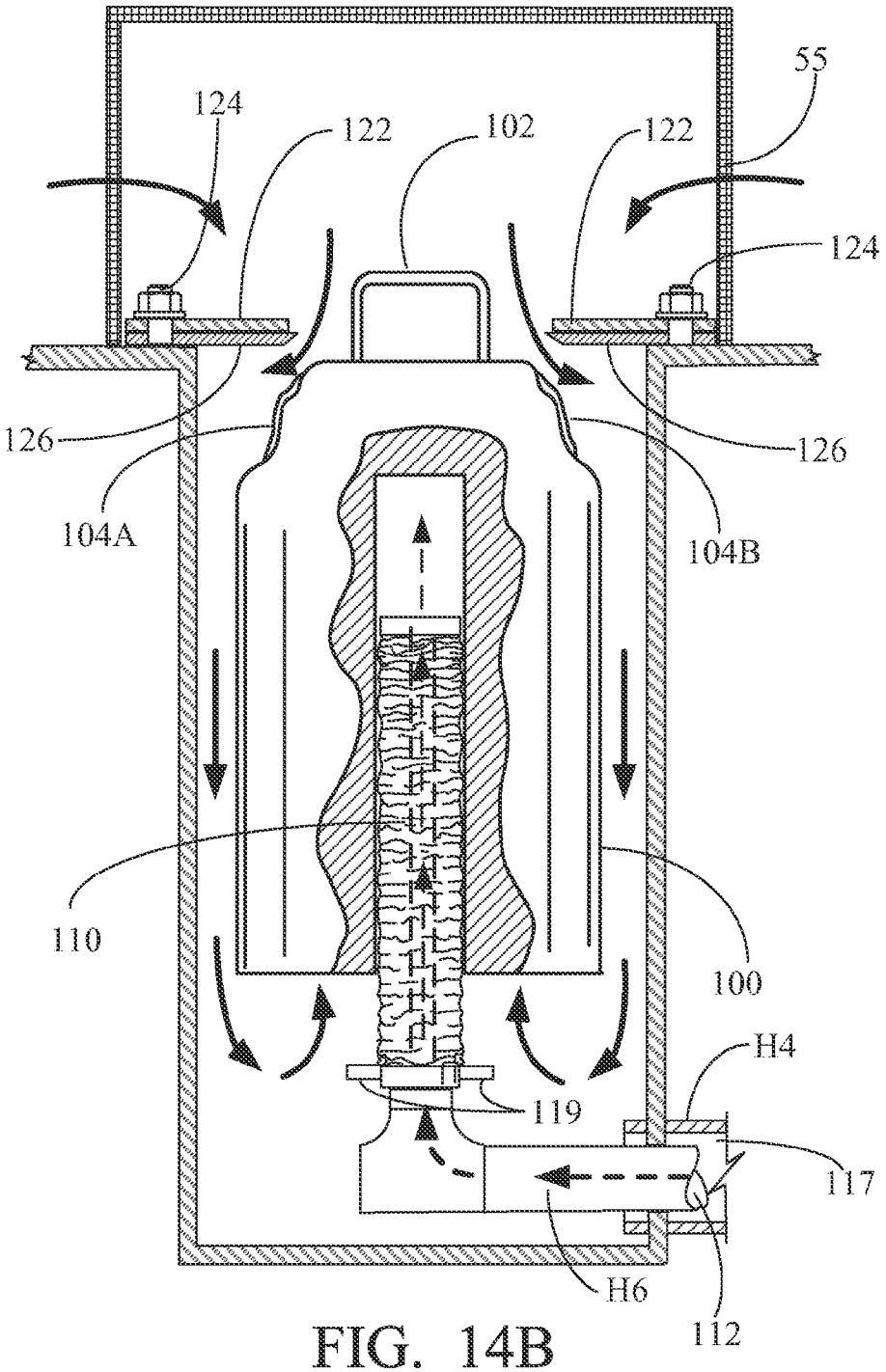
Figure 14C:
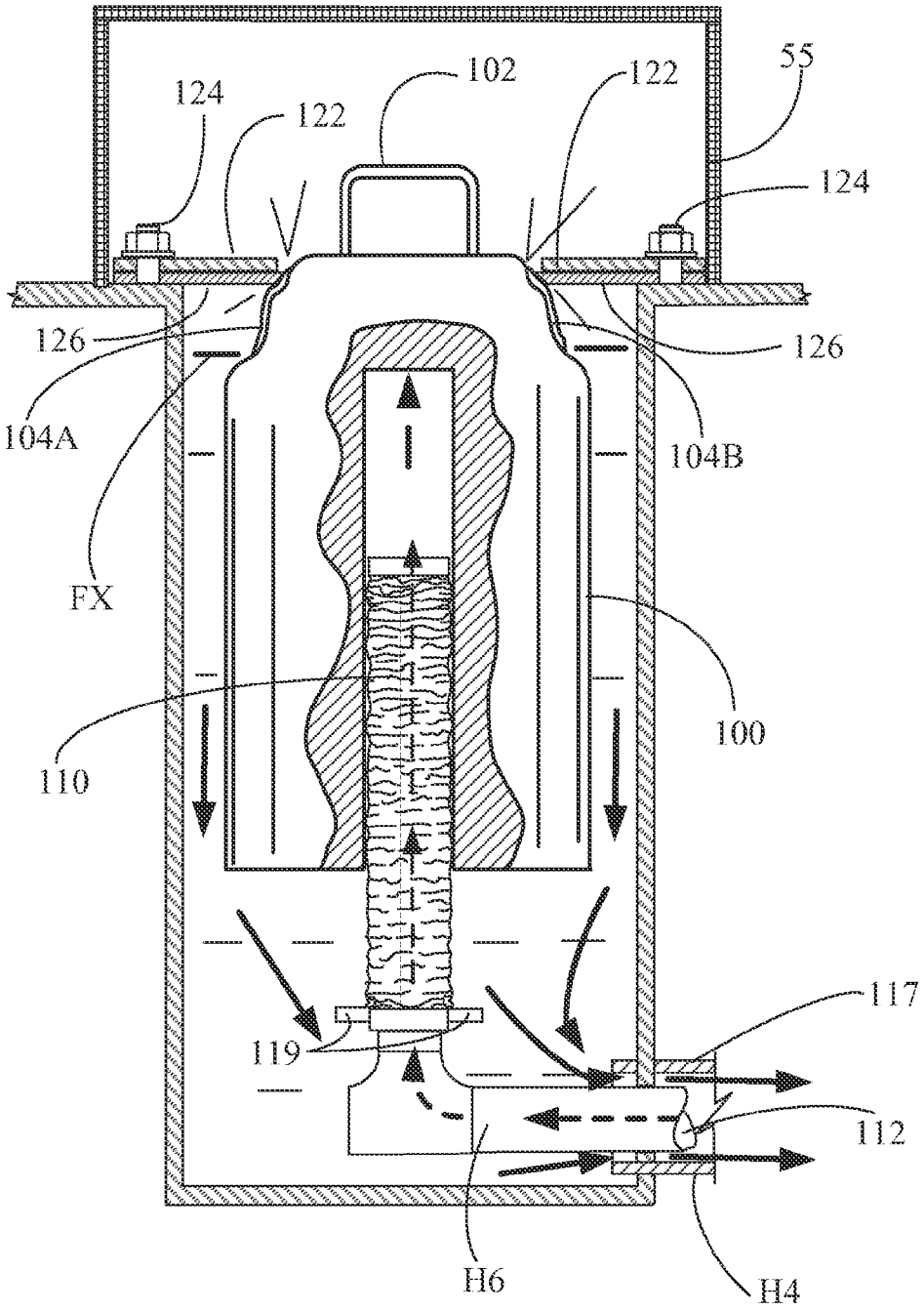

FIGS. 4A-4D and 14A-14C illustrate a complete fill cycle, at the end of which an amount of fluid or material in the discharge tank T3 is discharged. Beginning with FIG. 4A, a general block diagram of the vacuum cleaning system with a partial view of the discharge control plunger 100 in a non-discharge position (beginning of the fill cycle) is shown. In FIGS. 4A and 14A, the discharge tank T3 is essentially empty to begin the fill cycle. The plunger 100 is shown cut-away to reveal the fixed guide shaft 110. The plunger 100 is concentric with the guide shaft 110. As the plunger 100 rises to the top of the discharge tank T3, the plunger 100 slides along the guide shaft 110, as shown, for example, in FIGS. 4C and 14B. Thus, an air port 110A (FIG. 12) becomes open at the top of the fixed guide shaft 110. In the exemplary embodiment, the plunger is approximately 40 lbs. The plunger 100 in combination with tank T3 serves as a pump which can be sealed and unsealed automatically.

While not wishing to be bound by theory, when the plunger 100 is in a sealed position (FIGS. 4D and 14C) and the continuous vacuuming force is channeled through the primary collection tank T1, the weight of the plunger 100 should be sufficient to counter the vacuuming force so that automatic unsealing can take place. The ribs 104A and 104B may also provide aid in the unsealing action. The ribs weaken the seal.

In the exemplary embodiment, the conduit H6 from the air tank 60 extends through the bottom of the discharge tank T3. This extension of the conduit H6 is denoted at 112 and communicates air from the air tank 60 to the guide shaft 110.

Figure 12:
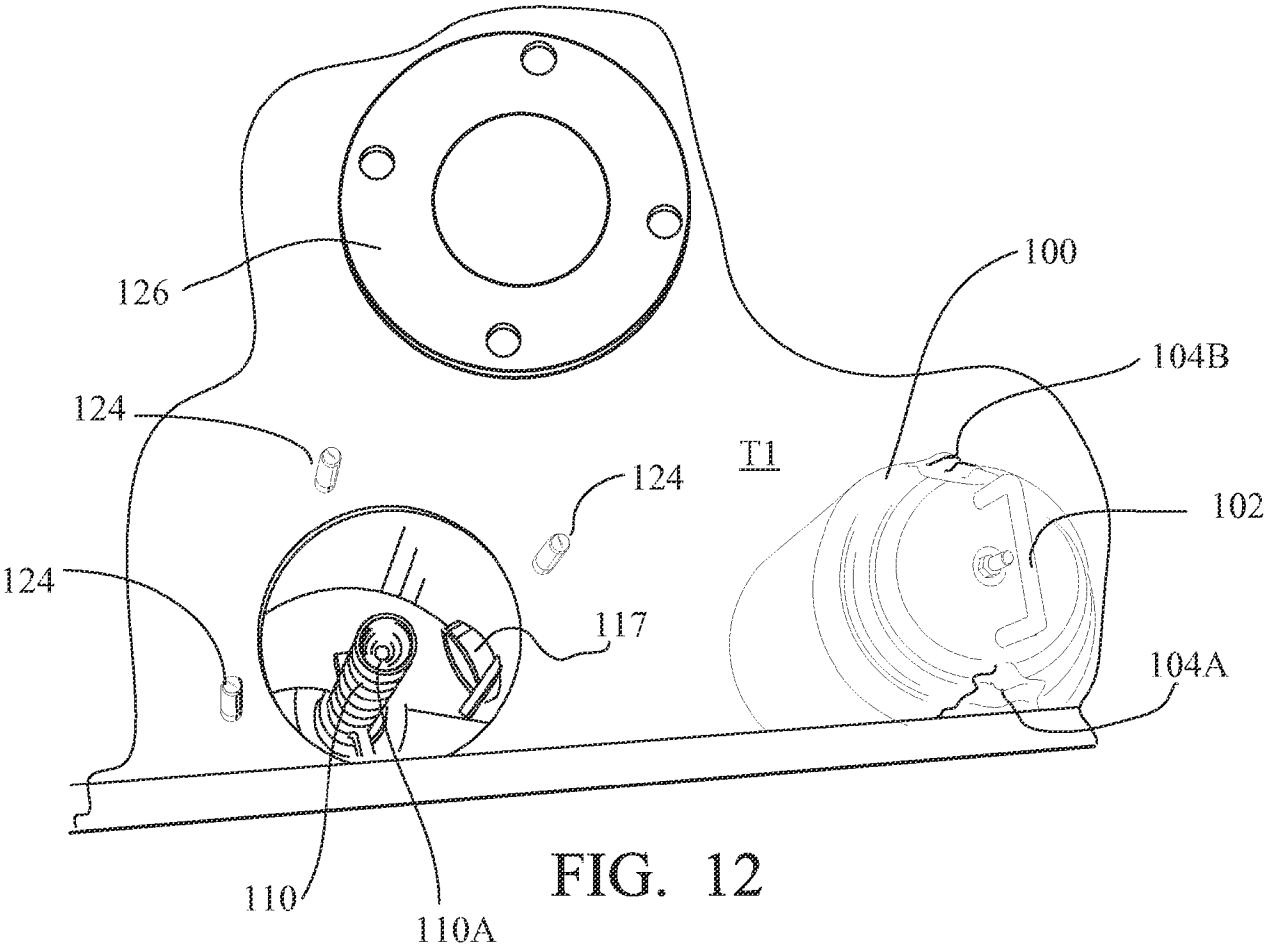
FIG. 12 illustrates a top interior view (partial) of the primary collection tank with the discharge control plunger removed depicting the interior of the discharge tank.

FIG. 12 illustrates a top view of the discharge tank T3. Specifically, the fixed guide shaft 110 is shown vertically aligned along a center axis of the discharge tank T3.

In FIGS. 4A and 14A, the plunger 100 is intended to block the communication of air from the air port 110A and into the discharge tank T3. Accordingly, when the plunger 100 is in the lowest non-discharge position, the air port 110A is essentially closed by the plunger 100. The arrows in the air hose AH and the conduit H6 denote the flow of air and path to the discharge tank T3 and up through the air port 110A.

Referring still to FIG. 4A, the arrows shown along hose SH through the collection and discharge unit 40 and to the vacuum unit 20 are not intended to represent the entire length traveled by the suctioned air. The dashed lines in the center of conduit H4 denotes the path taken by the discharged fluid or material collected in the tank T3 when discharged. However, the dashed lines denote the path only of the discharged fluid or material.

Figure 4B:
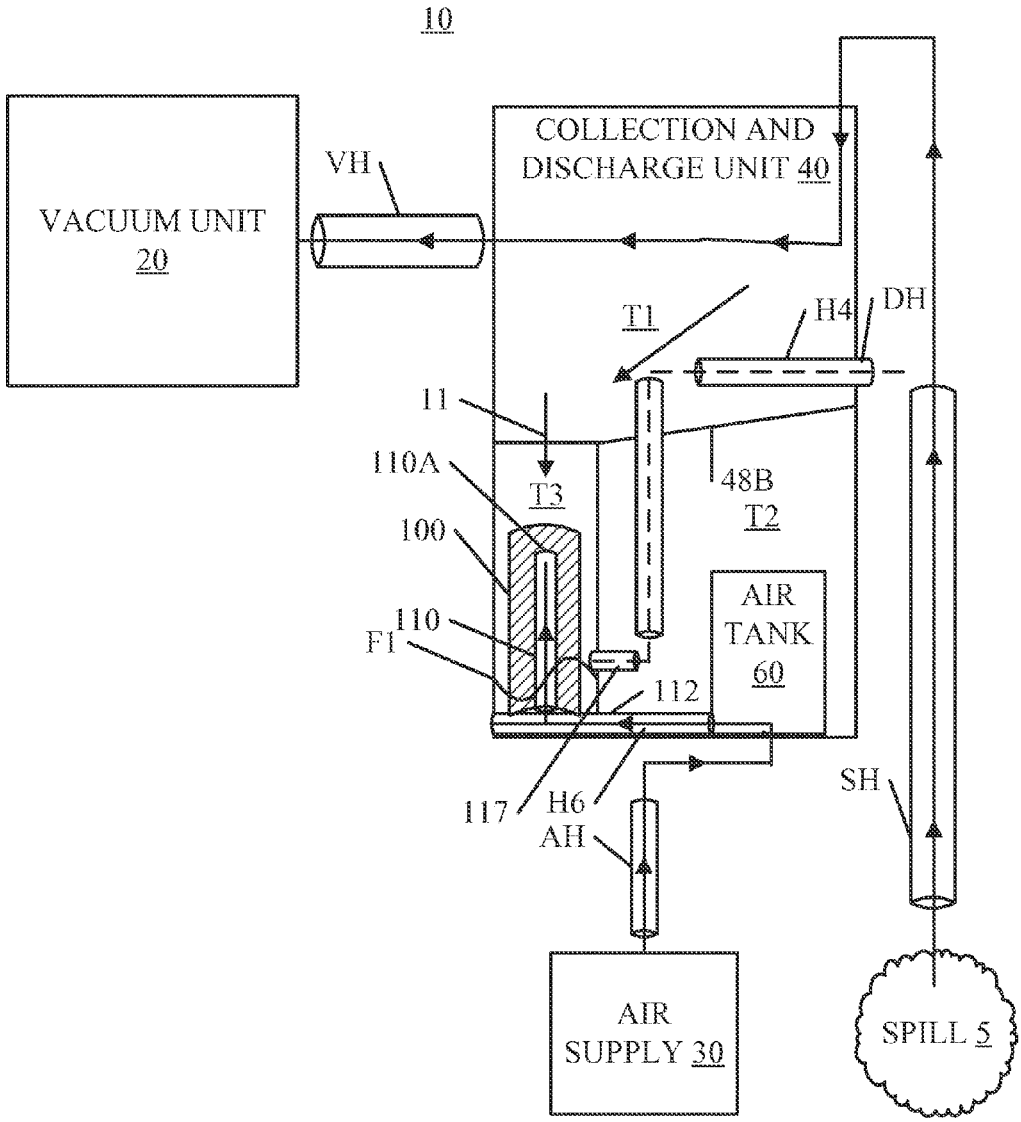
FIG. 4B illustrates a general block diagram of the vacuum cleaning system with a partial view of the discharge control plunger in a non-discharge position and with the discharge tank partially filled.
Figure 4C:
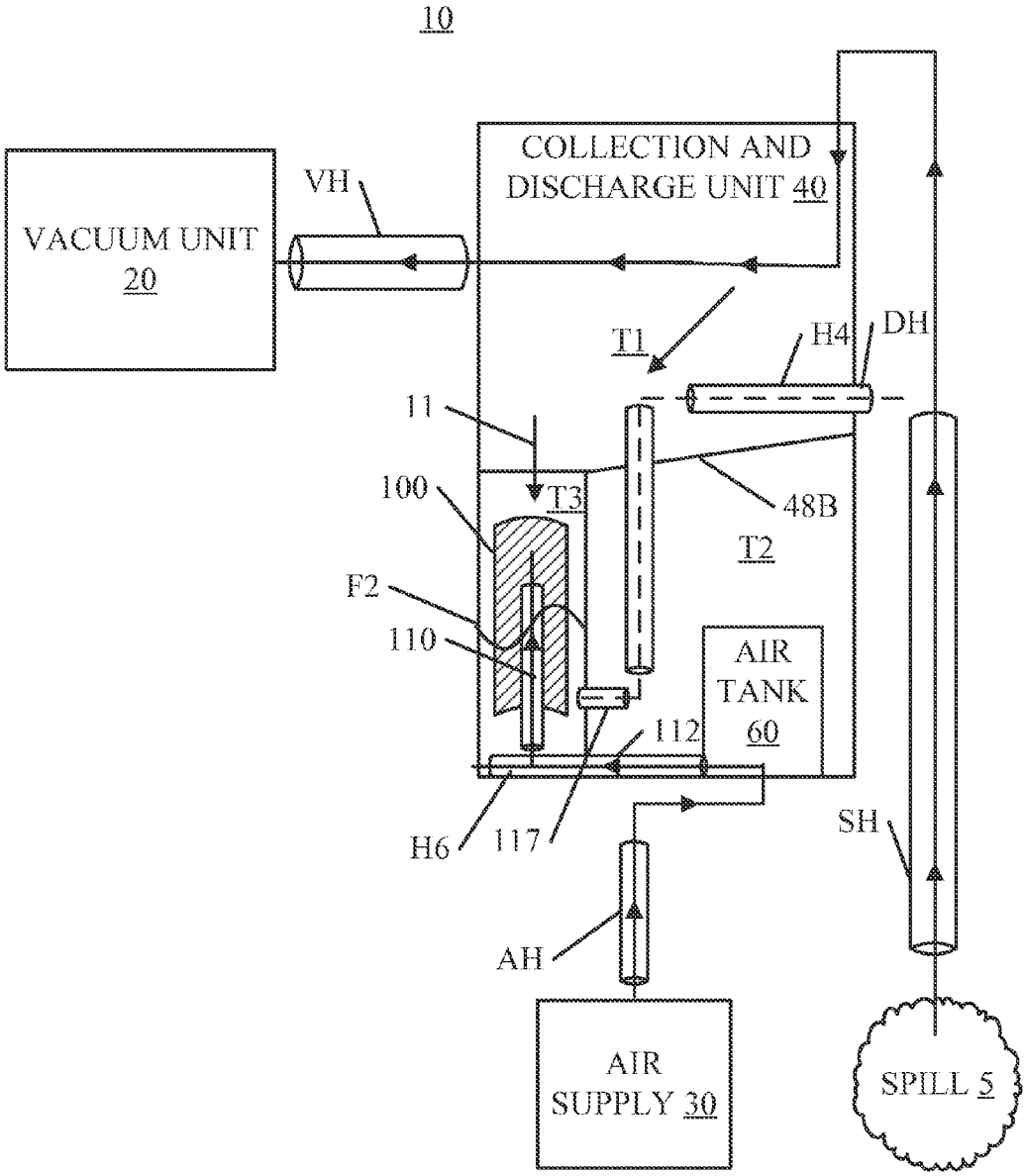
FIG. 4C illustrates a general block diagram of the vacuum cleaning system with a partial view of the discharge control plunger in an intermediary non-discharge position of the fill cycle and with the discharge tank partially filled.
Figure 4D:
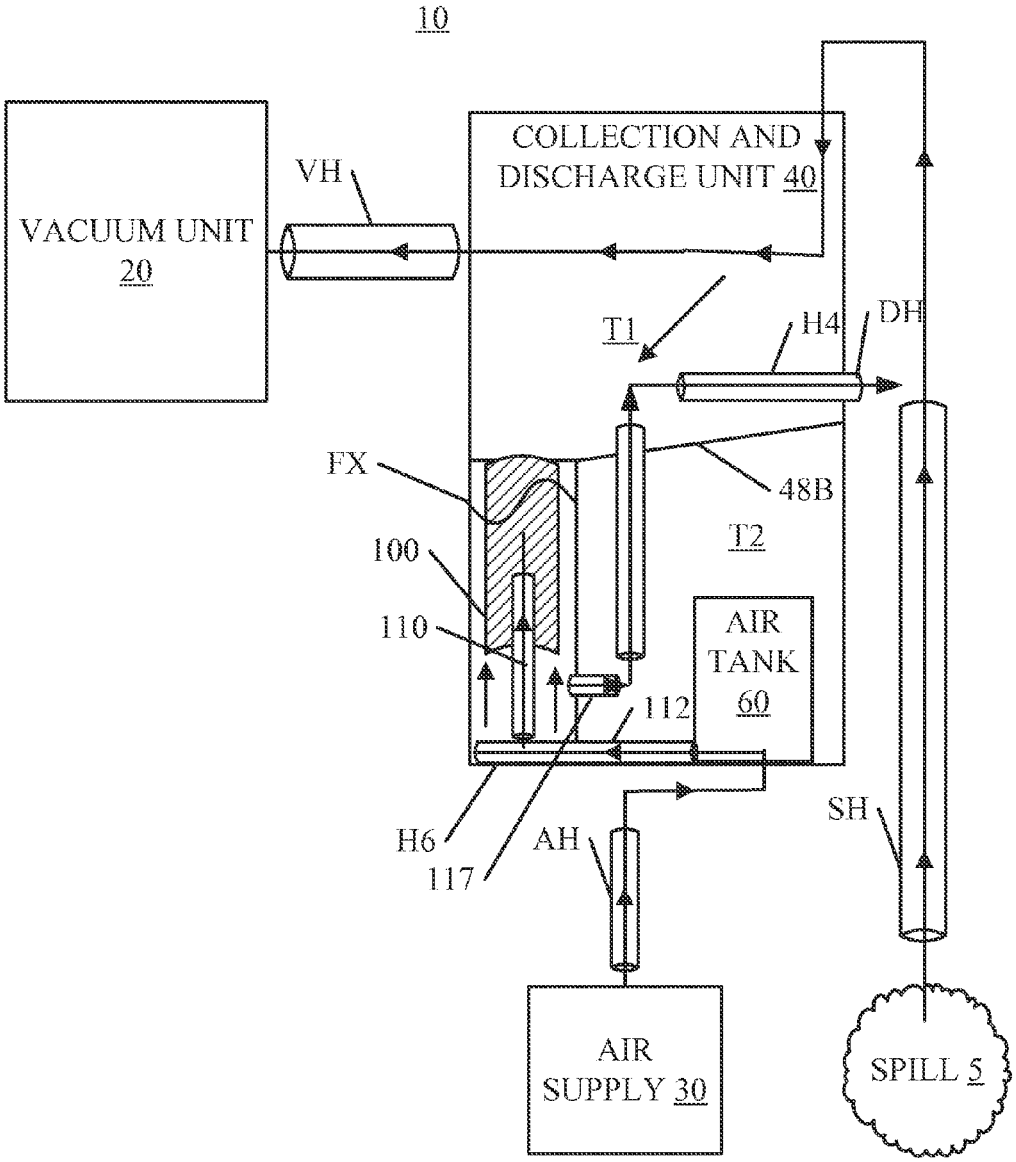
FIG. 4D illustrates a general block diagram of the vacuum cleaning system with a partial view of the discharge control plunger in a sealed or discharge position and with the discharge tank filled (completed fill cycle).

FIG. 4B illustrates a general block diagram of the vacuum cleaning system with a partial view of the discharge control plunger in a non-discharge position and with the discharge tank T3 partially filled to fill line F1. As the fluid or material is suctioned, the fluid or material enters the primary collection tank T1. The sub-floor 48B is sloped in the direction of the opening 114 of tank T3 in the sub-floor 48B, as best seen in FIGS. 8-12. The arrow 11 denotes the flow of the fluid or material under gravity into tank T3 from the primary collection tank T1. The arrows in tank T1 to the vacuum unit 20 denotes the flow of air out of the collection and discharge unit 40. In FIGS. 4B-4D, the cage 55 has been removed to simplify the depiction of the invention.

FIG. 4C illustrates a general block diagram of the vacuum cleaning system 10 with a partial view of the discharge control plunger 100 in an intermediary non-discharge position and with the discharge tank T3 partially filled to fill line F2. The fill line F2 represents an amount of fluid or material that is sufficient to displace the weight of the plunger 100 so that the plunger 100 is raised above the lowest non-discharge position and which opens the air port 110A into the tank T3. The arrow 11 denotes the flow of the fluid or material under gravity into tank T3. The arrows in tank T1 to the vacuum unit 20 denotes the flow of air out of the collection and discharge unit 40 but not necessarily the actual path. In FIG. 4C, once the air port 110A is open, the tank T3 also begins to fill with air under pressure and facilitates with the elevation of plunger 100 to the discharging position or sealing position.

FIG. 4D illustrates a general block diagram of the vacuum cleaning system 10 with a partial view of the discharge control plunger 100 in a sealed or discharge position and with the discharge tank T3 filled to fill line FX. Once the plunger 100 has reached the top of the tank T3, the plunger 100 seals the opening 114 thereby sealing the discharge tank T3 for additional fluid or material still being vacuumed into the primary collection tank T1. This completes the fill cycle. (See also FIG. 14C.) After the tank T3 is sealed and the fill cycle complete, the fluid or material in tank T3 is discharged through conduit H4 and out to the open atmosphere via the discharge hose DH. The accumulation of pressurized air in the discharge tank T3, effectuates a blow-out of the amount of fluid or material in the discharge tank T3. In FIG. 4D, the arrows in the conduit H4 represent the communication of the fluid or material along the discharge hose DH. This completes the discharge cycle.

The automatic discharging cycle of the collection and discharge unit allows drilling fluid to be rapidly vacuumed up and discharged to minimize settlement of debris in the collected material. In one aspect of the invention, the air pressure is intended to blow-out forcefully the contents of the discharge tank T3.

Figure 5:
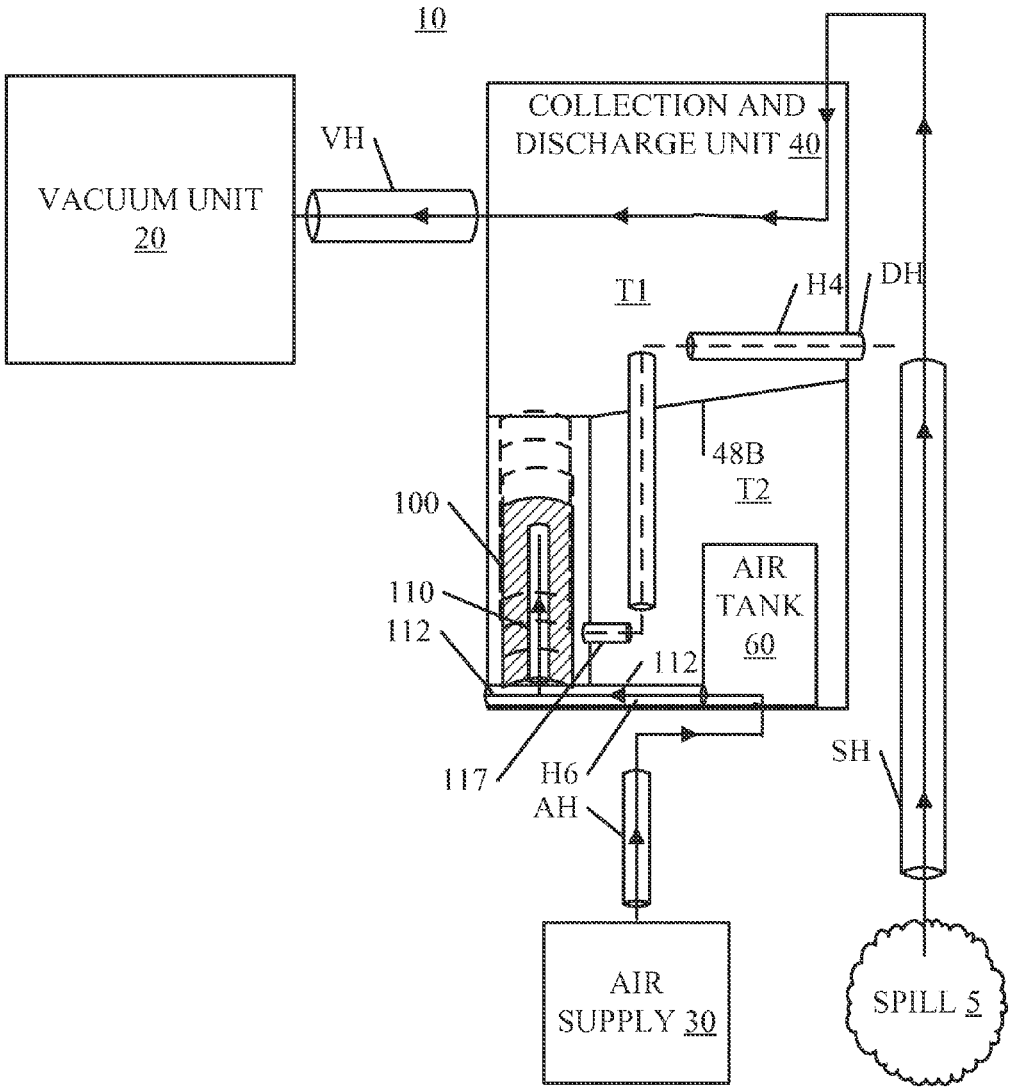
FIG. 5 illustrates a general block diagram of the vacuum cleaning system with a partial view of the discharge control plunger automatically moving downward to the non-discharge position to restart the fill cycle.
Figure 14D:
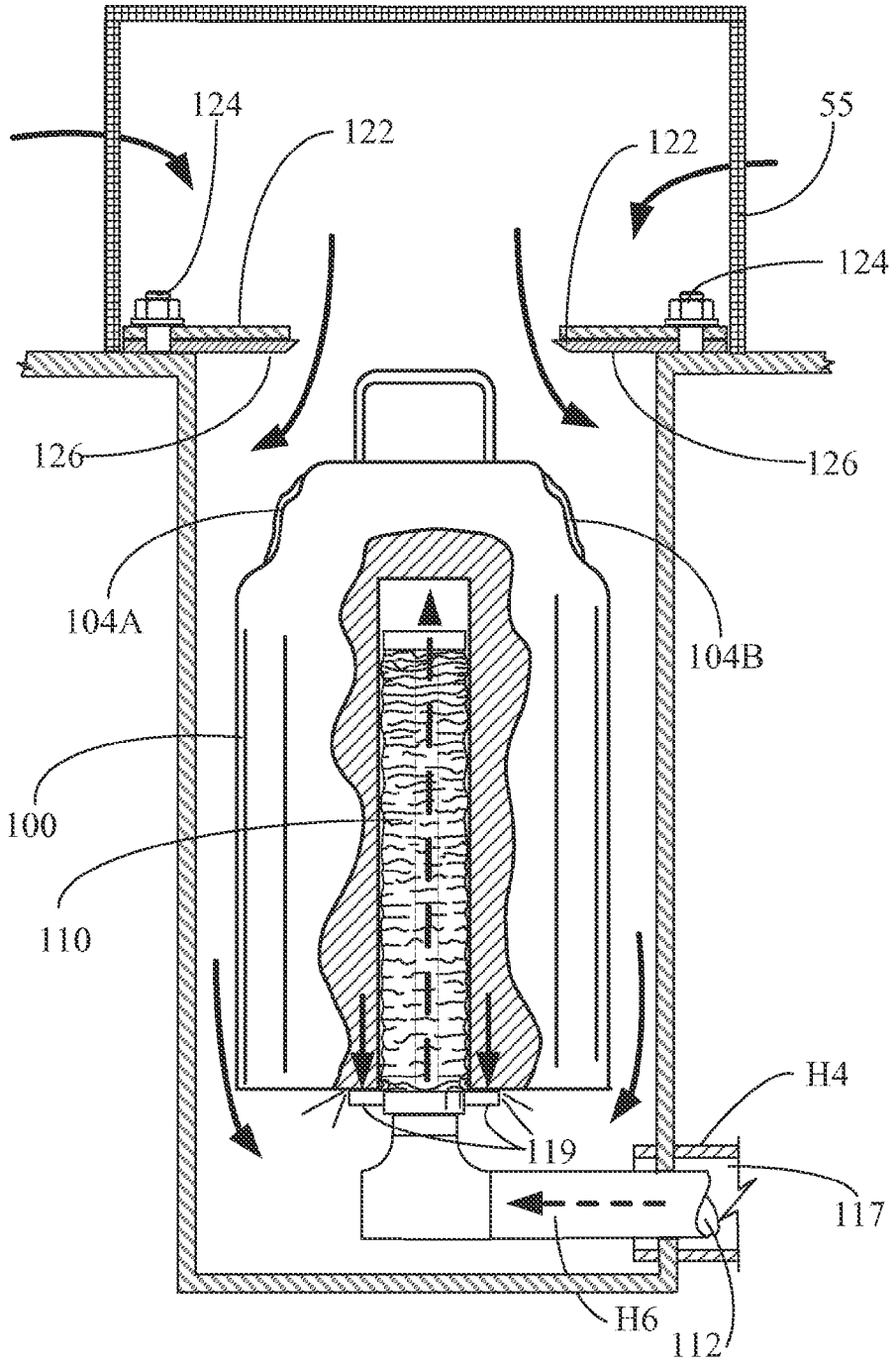
FIG. 14D illustrates the return of the discharge control plunger to begin a subsequent fill cycle.

FIG. 5 illustrates a general block diagram of the vacuum cleaning system 10 with a partial view of the discharge control plunger 100 automatically moving downward to the non-discharge position. (See also FIG. 14D). Hence, the air flow along the conduit H6 and 112 is shut off. In general, the seal at opening 114 is broken by the weight of the plunger 100 as well as the construction and arrangement of the plunger 100. The plunger 100 shown in dashed lines denotes the movement of the plunger 100 downward to the lowest non-discharge position. Thus, the fill cycle commences or repeats automatically. After the subsequent fill cycle is complete, the fluid or material in the tank T3 is again automatically discharged.

The top of the plunger has a handle 102. The shoulder of the plunger has two ribs 104A and 104B, as best seen in FIGS. 9-12, which allows the seal to be broken after the fluid or material has been discharged under pressure.

Figures 13A, 13B, 13C, 13D:
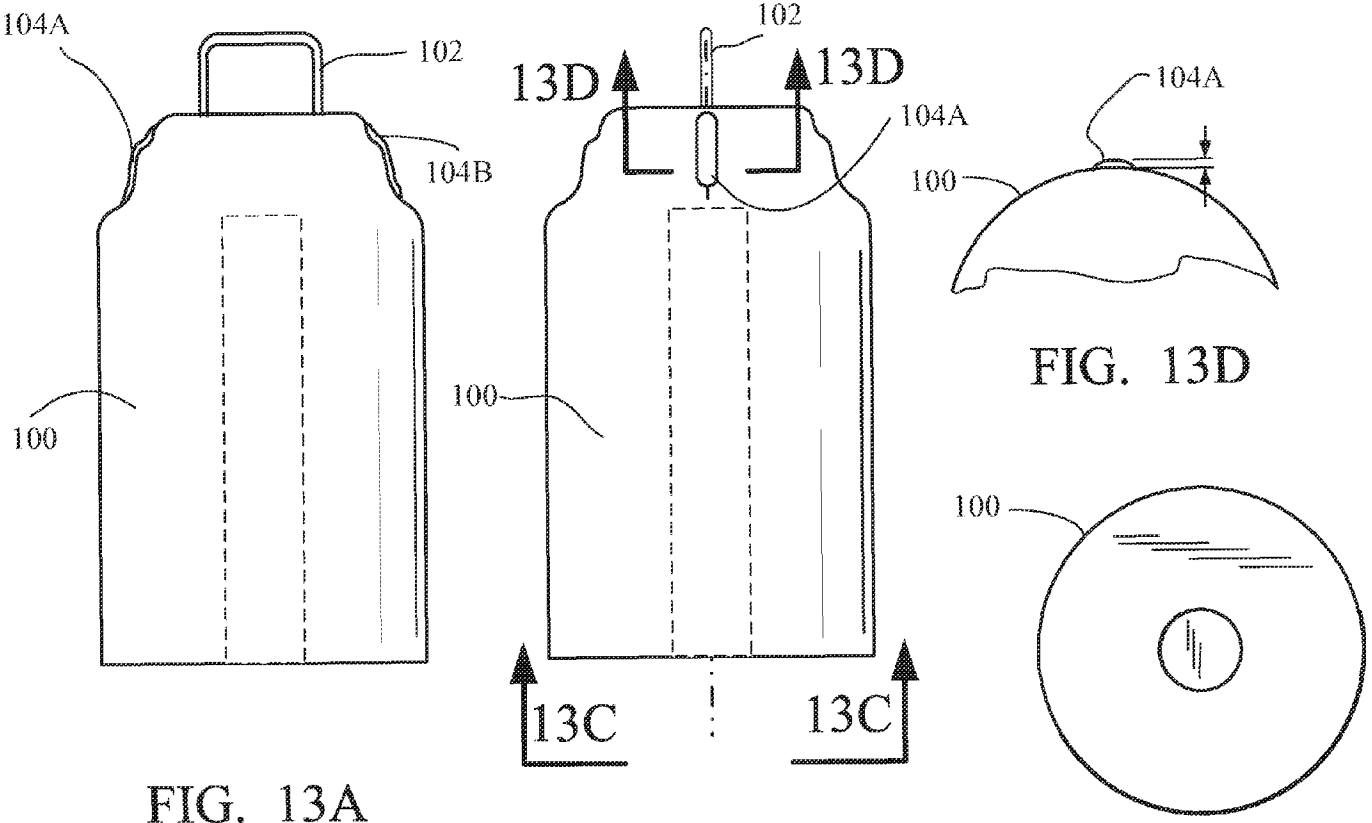
FIG. 13A illustrates a side view of the discharge control plunger with the center shown in phantom.
FIG. 13B illustrates a side view of the discharge control plunger with the center shown in phantom and rotated approximately 90 degrees with respect to the view in FIG. 13A.
FIG. 13C is a cross-sectional view along the plane 13C-13C in FIG. 13B.
FIG. 13D is a cross-sectional view along the plane 13D-13D in FIG. 13B.

FIG. 13A illustrates a side view of the discharge control plunger 100 with the center shown in phantom. The plunger 100 has a cylindrical body with a top handle 102. The cylindrical body tapers to form a shoulder for the placement of ribs 104A and 104B. The interior of the cylindrical body is hollow for the placement of the fixed guide shaft 110. The ribs 104A and 104*b* are shown raised from the main body of the plunger 100. The handle 102 is shown as a U-shaped member to lift the plunger 100.

FIG. 13B illustrates a side view of the discharge control plunger with the center shown in phantom and rotated approximately 90 degrees with respect to the view in FIG. 13A. In this orientation, the rib 104A is shown essentially aligned with a leg of handle 102.

FIG. 13C is a cross-sectional view along the plane 13C-13C in FIG. 13B to illustrate a bottom end of the plunger 100. FIG. 13D is a cross-sectional view along the plane 13D-13D in FIG. 13B to illustrate the raised profile of rib 104A with respect to the main body of plunger 100.

Figure 6:
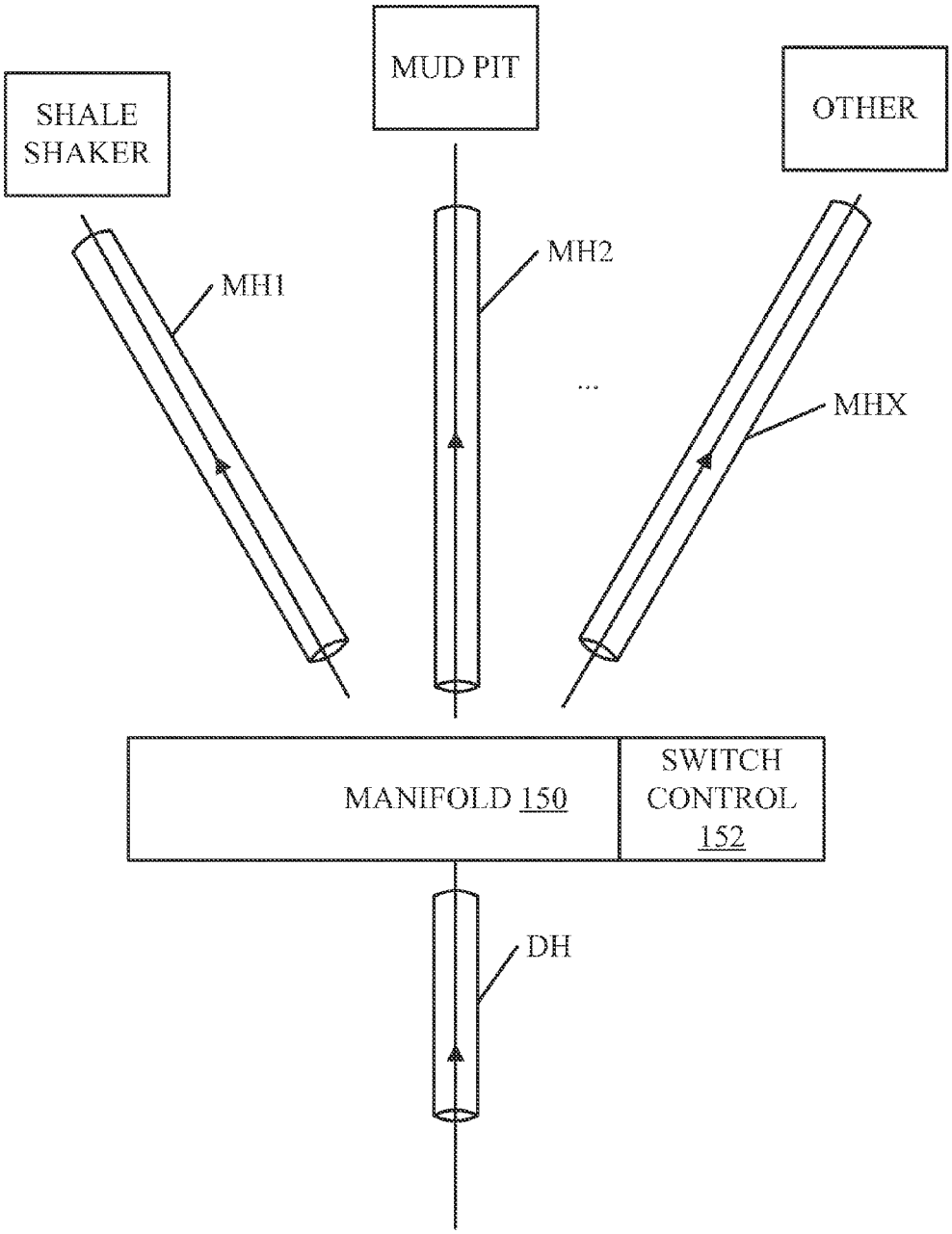
FIG. 6 illustrates a general block diagram of a manifold with multiple output lines.

FIG. 6 illustrates a general block diagram of a manifold 150 with multiple output lines MH1, MH2 . . . MHX. The manifold 150 is controlled by switch control 152 to change the flow of fluid along the discharge hose DH to any one of the multiple output lines MH1, MH2 . . . MHX. By way of example, the output line MH1 may be used to discharge into the shale shaker. On the other hand, the output line MH2 may be used to discharge into an active mud pit. Nevertheless, the output line MHX may be used to discharge any other location, holding tank or pit desired.

Referring again to FIGS. 8-12, the top interior view (partial) of the primary collection tank T1 of an exemplary embodiment is shown. The cage 55 (FIG. 8) is created by expanded wire. The holes in the cage 55 prevent large size debris from entering the discharge tank T3.

Figure 9:
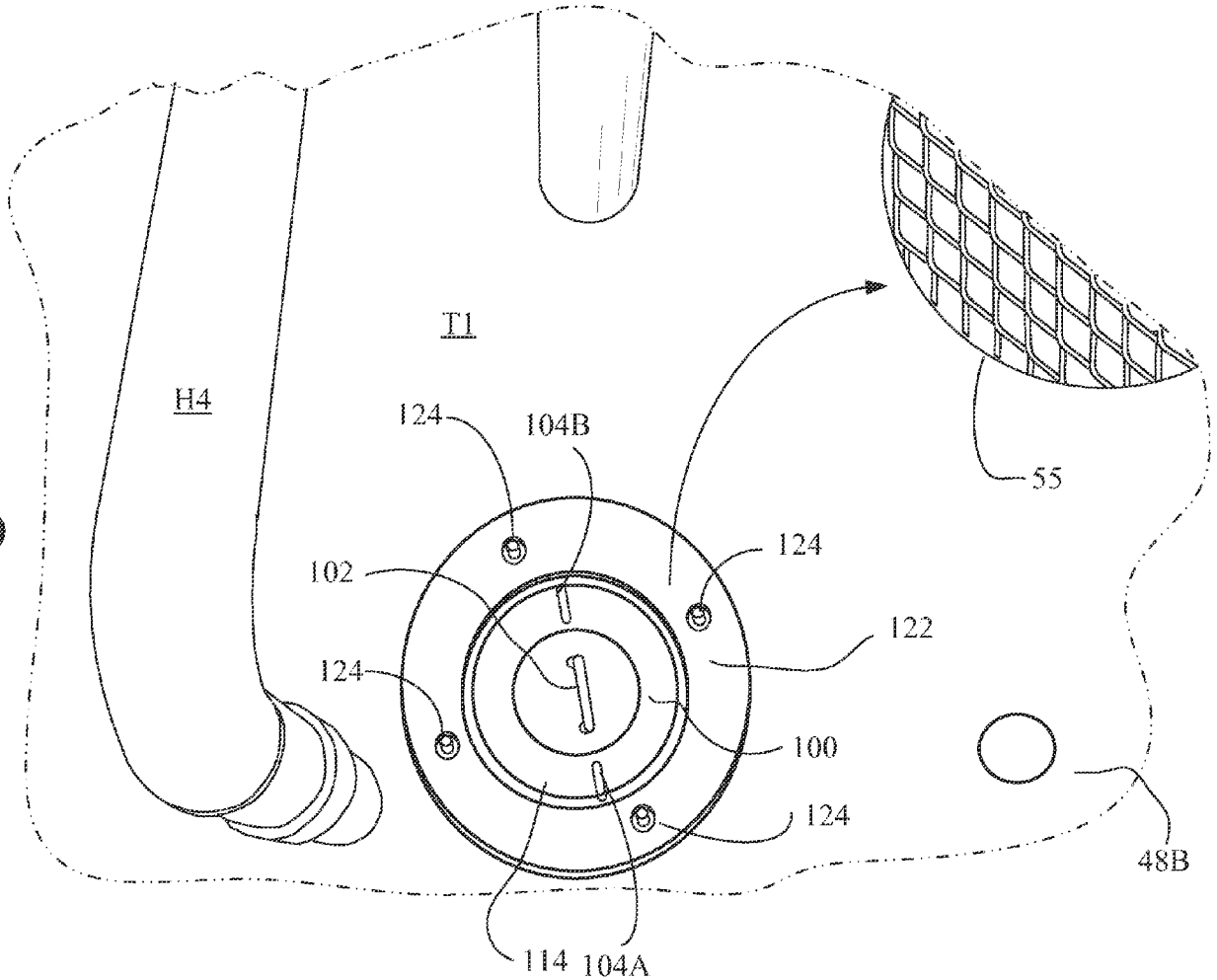
FIG. 9 illustrates the top interior view (partial) of FIG. 8 with the cage removed.
Figure 10:
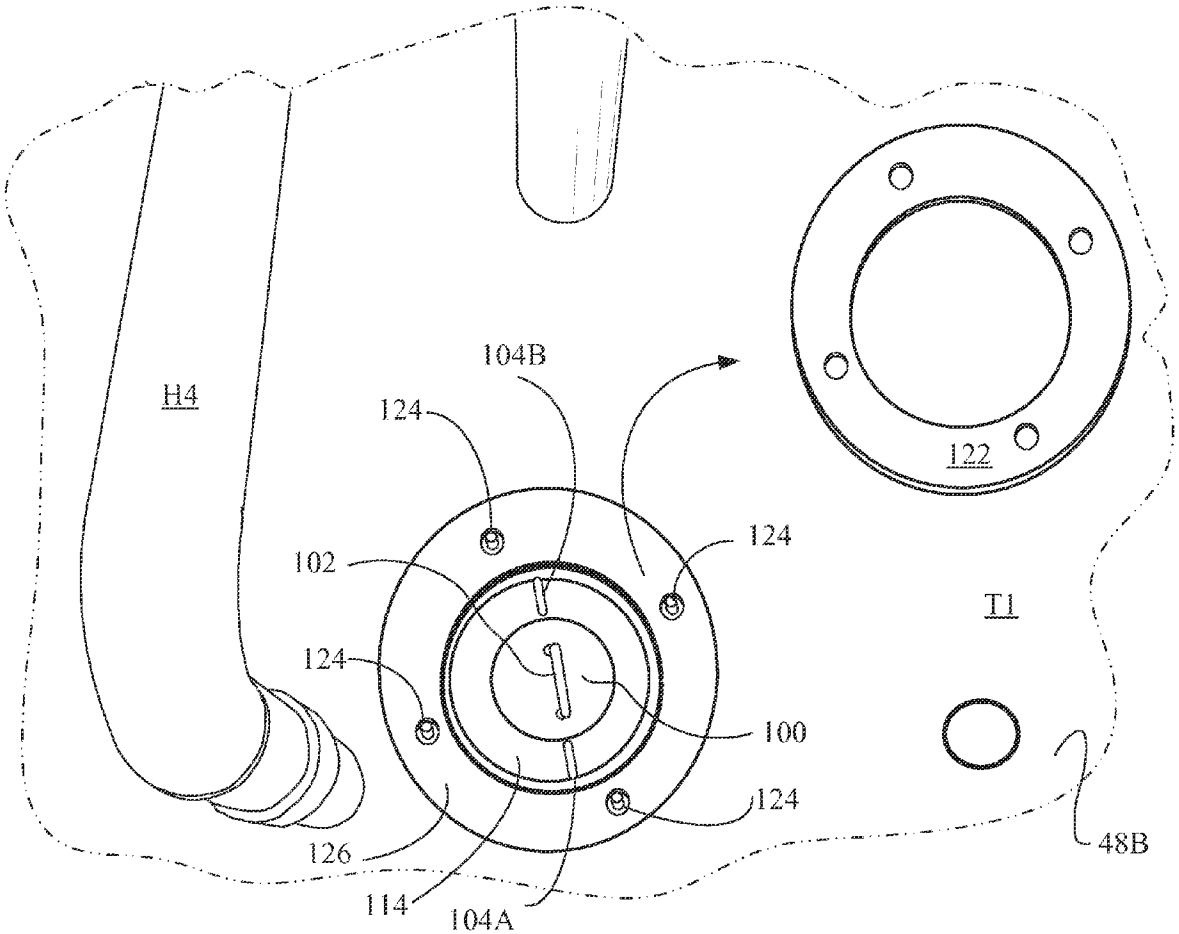
FIG. 10 illustrates the top interior view (partial) of FIG. 9 with a top cover of the sealing assembly removed.

The cage 55, in FIGS. 9-12, is removed from the intended location to illustrate the top of the discharge control plunger 100. In operation, the seal is created by the top of the plunger 100 forced against the O-ring sealing member 126 best seen in FIGS. 10 and 14C. In FIG. 9, the top O-ring cover member 122 is shown secured and bolted in place via fasteners 124 over the O-ring sealing member 126. In FIG. 10, the cover O-ring cover member 122 is removed and only the O-ring sealing member 126 is around the opening 114.

Figure 11:
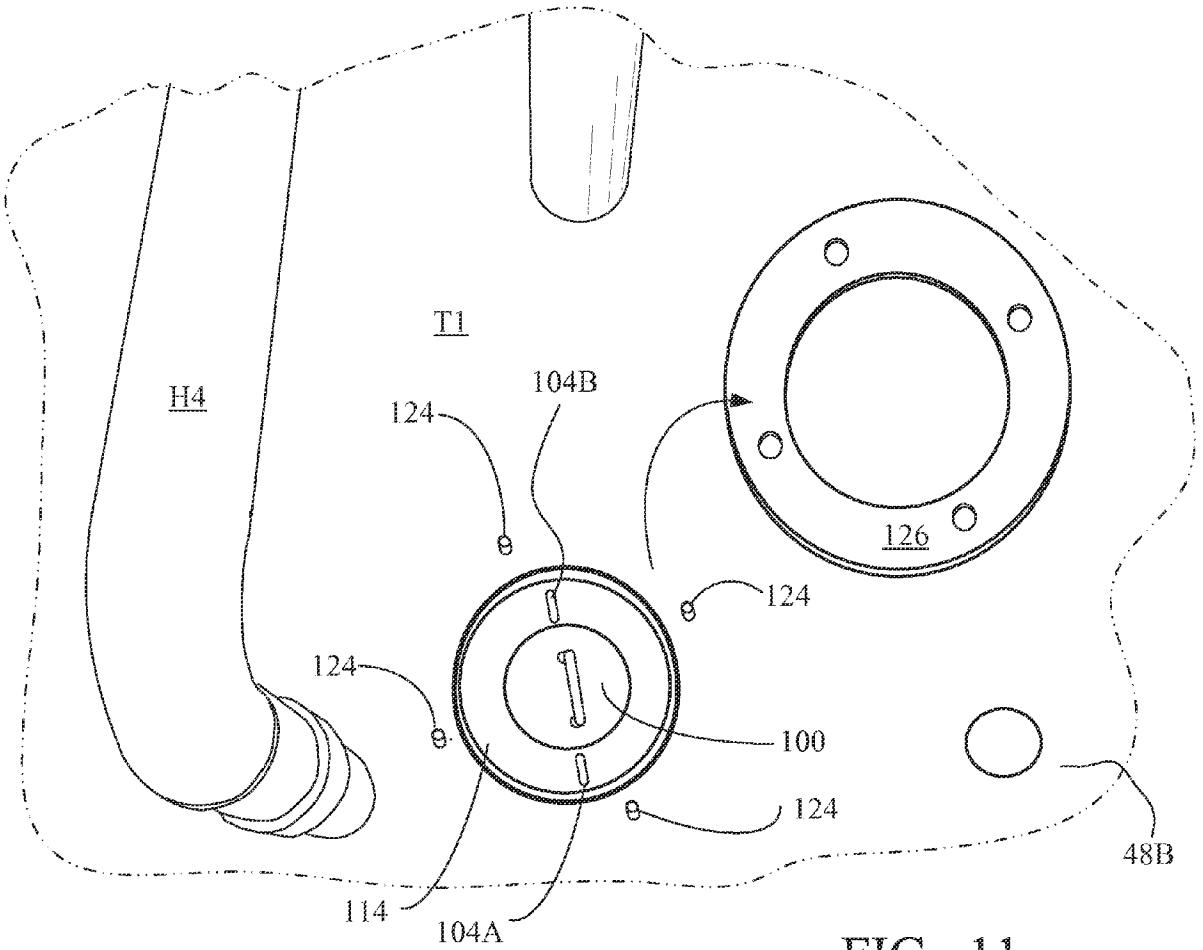
FIG. 11 illustrates the top interior view (partial) of FIG. 10 with a top cover and sealing ring of the sealing assembly removed.

In the exemplary embodiment, as best seen in FIGS. 10 and 11, both the O-ring sealing member 126 and the top O-ring cover member 122 have a plurality of holes which align with an arrangement of threaded bolts or other fasteners to secure them to the sub-floor 48B.

Figure 15:
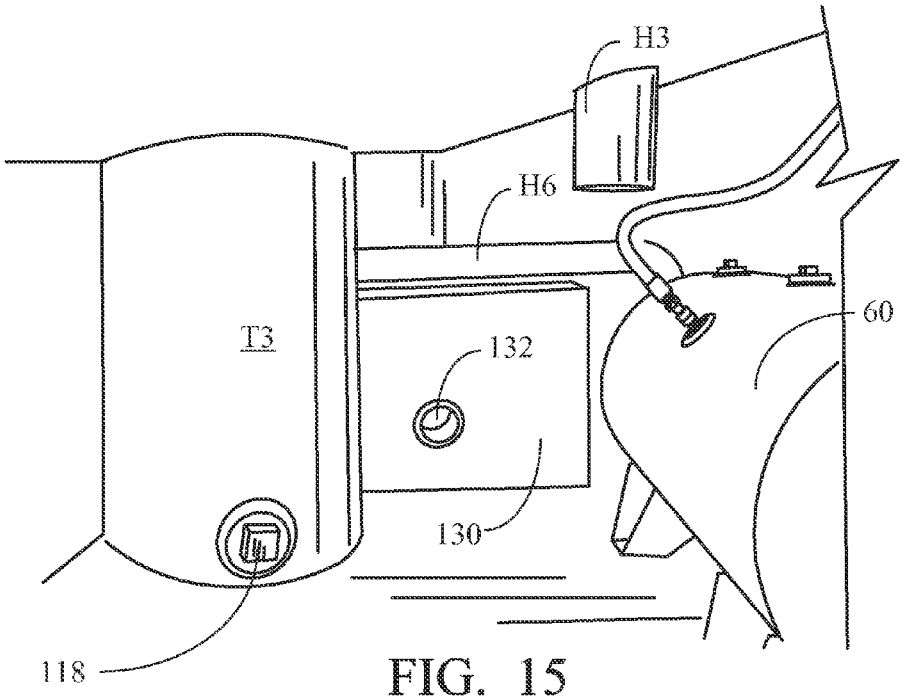
FIG. 15 illustrates a partial view of the reserve collection tank.
Figure 16:
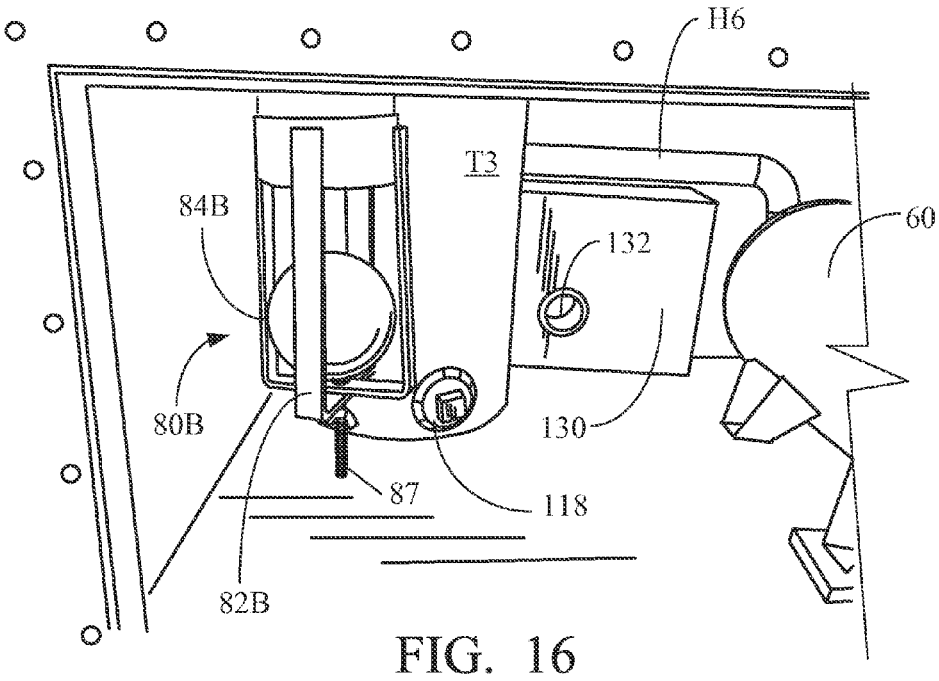
FIG. 16 illustrates a further partial view of the reserve collection tank.
Figure 19:
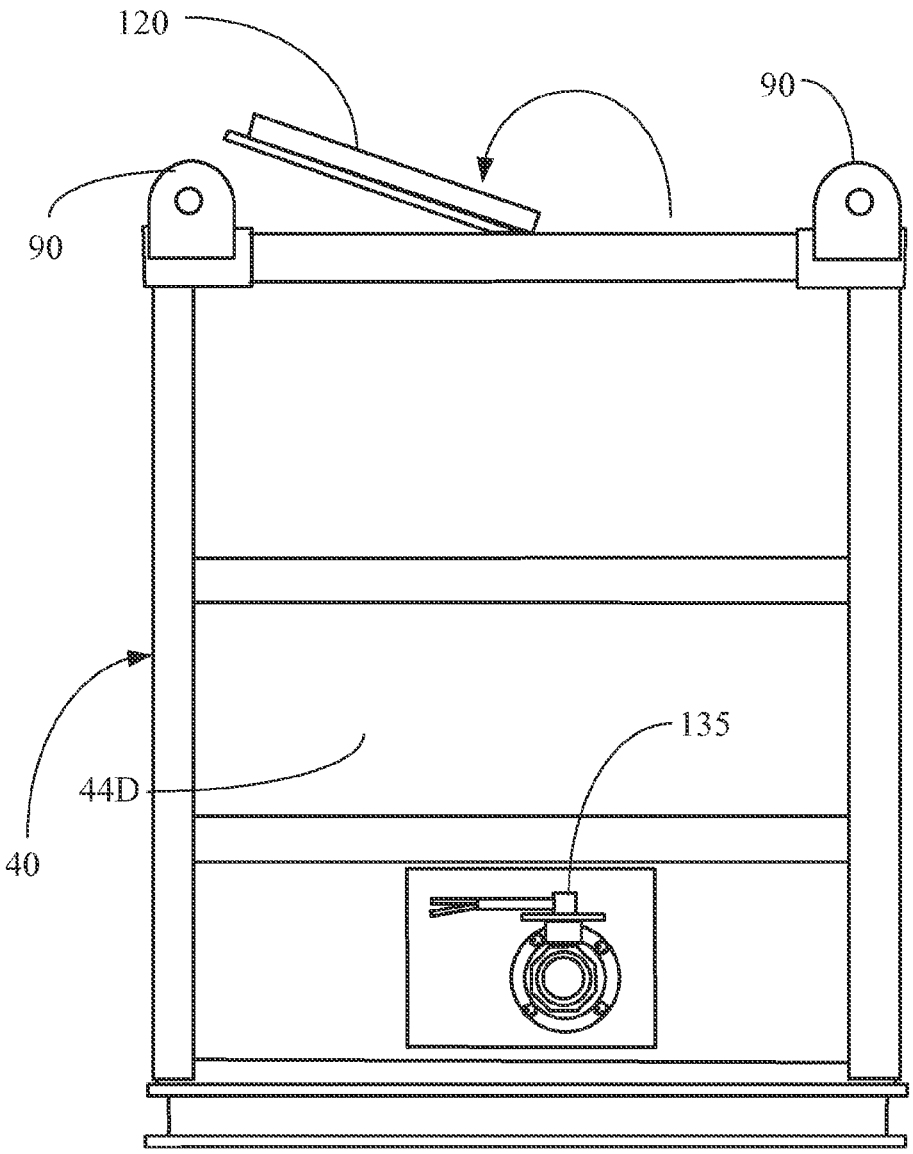
FIG. 19 illustrates a back view of the collection and discharge unit.

FIGS. 15-16 illustrate partial views of the reserve collection tank T2. FIG. 24 illustrates the rear of the housing 42. In the partial view of FIGS. 15 and 16, the clean-out port 118 of the discharge tank T3 is shown. The clean-out port 118 is closed via a valve. Behind the discharge tank T3, a generally box-shaped member 130 is shown. Referring also to FIGS. 19 and 22, the box-shaped member 130, which is formed in the side wall 44D, forms a recessed cavity when viewing externally. The cavity houses therein valve 135 for draining the reserve collection tank T2 via port 132. The recessed cavity protrudes into the reserve collection tank T2 which is represented by the boxed-shaped member 130.

The internal safety shut-off 80B in the reserve collection tank T2 of an exemplary embodiment is shown in FIG. 16. The internal safety shut-off 80B includes a ball-shaped plunger or float 84B secured in an open cage channel 82B. The channel 82B confines the float 84B therein by bands or strips of metal. The opening to conduit H2 in the reserve collection tank T2 is protected by filter 86. (See FIGS. 17A & 17B). The opening is intended to be closed if the fluid or material in the reserve collection tank T2 exceeds the capacity of tank T2. This is a safety feature in case of a malfunction of the internal safety shut-off 80A in the primary collection tank T1. In neither tanks T1 nor T2 should the fluid or material exceed the capacities of the tanks. However, the internal safety shut-offs 80A and 80B provide a safety feature in case of failure.

Figure 17B:
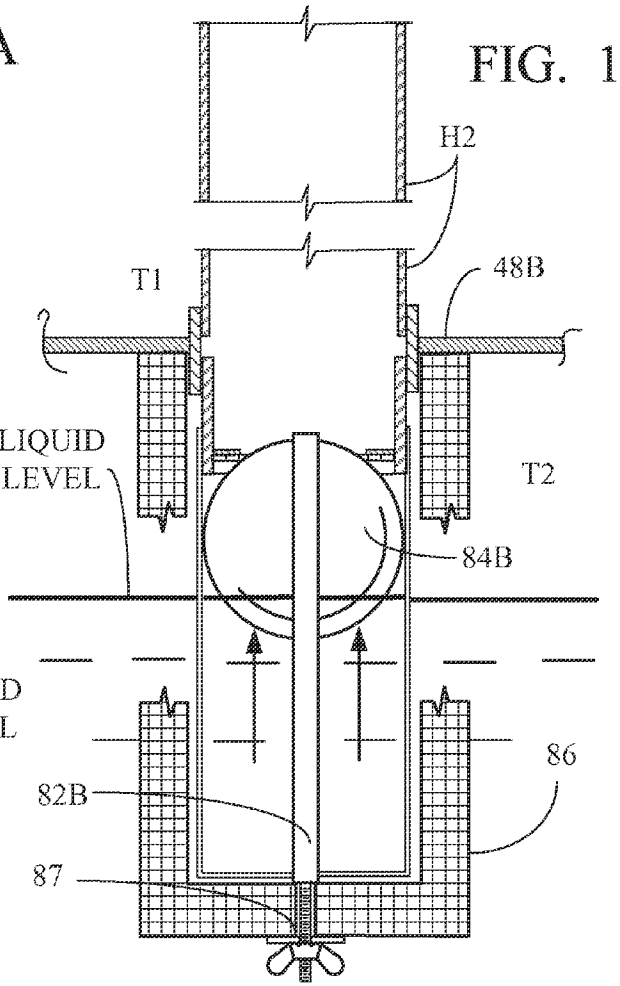
FIG. 17B illustrates the internal safety shut-off of the reserve collection tank with the float in the shutoff position.
Figure 17A:
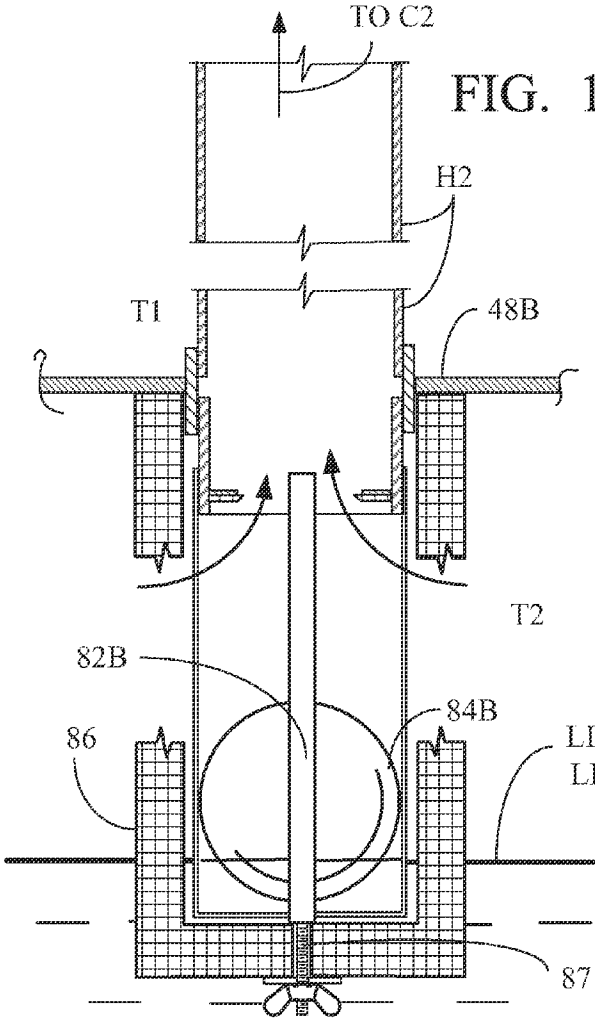
FIG. 17A illustrates an internal safety shut-off of the reserve collection tank with a float in a non-shutoff position.

FIG. 17A illustrates the internal safety shut-off 80B, in the reserve collection tank T2, with the float 84B at the lower end of the open cage channel 82B. When float 84B is at the lower end of the open cage channel 82A, the opening to conduit H2 remains open. This illustration represents the non-shutoff position of the float 84B. FIG. 17B illustrates the internal safety shut-off 80B with the float 84B at the upper end of the open cage channel 82B as the fluid level rises. When float 84B is at the upper end of the open cage channel 82A, the opening to conduit H2 is closed. This illustration represents the shut-off position of float 84B.

FIGS. 17A and 17B also illustrate the filter 86. The filter 86 is a wire mesh filter which protects the vacuum unit 20 from debris and particulate matter in the reserve collection tank T2. The filter 86 is constructed to prevent fine debris from being suctioned to the vacuum unit 20.

Figure 18:
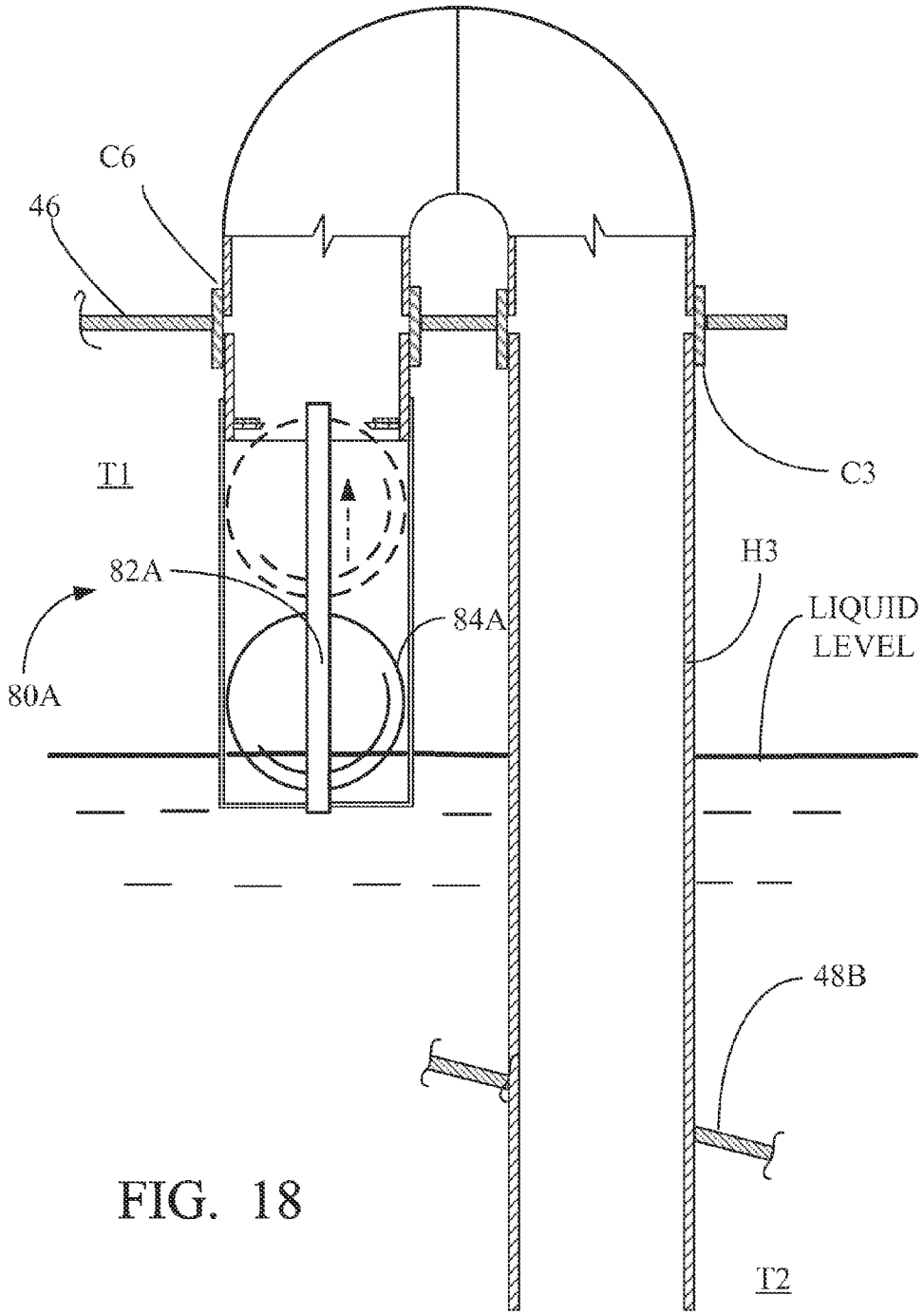
FIG. 18 illustrates an internal safety shut-off of the primary collection tank with a float in a non-shutoff position and a shutoff position (in phantom).

FIG. 18 illustrates the internal safety shut-off 80A in the primary collection tank T1. The internal safety shut-off 80A includes a ball-shaped plunger or float 84A secured in an open cage channel 82A. The channel 82A confines the float 84A therein by bands or strips of metal. The internal safety shut-off 80A is positioned to close the flow of fluid out of connector C6 to external (jumper) conduit JH.

The float 84A is shown at a lower end (non-shutoff position) of the open cage channel 82A. The float 84A is also shown in phantom at the upper end (shutoff position) of the open cage channel 82A to close the opening as the fluid level rises.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

PARTS LIST

44A—¼" Plate
44B—¼" Plate
44C—¼" Plate
44X—3½" Square Tube
45—2" THRD Collar (Ball valve and cam lock)
46—¼" Plate
46X—3½" Square Tube
48A—⅜" Plate
48B—⅜" Plate
50—¼" Plate Cover with Neoprene Gasket
52—Bolt
64—1" THRD Collar
66—½" THRD Collar (Ball Valve Bleeder)
C1—4" THRD Elbow with Cam Lock Fitting
C2—4" THRD Collar with Cam Lock Fitting
C3—4" Welded Collar
C4—3" THRD collar with BRZ check valve
C6—4" Welded Collar
H1—4" Welded Elbow
H2—4" SCH 80 Pipe
H3—4" SCH 80 Pipe
H4—3" SCH 80 Pipe
H5—Air Supply Hose
H6—2" SCH 80 Pipe
JH—4" 2-Elbows
90—¾" Plate (pad eye type)
120—¼" Plate
135—3" Butterfly Valve with Cam Lock
142—½" 2-plates (hinge)
142*a*—¾" Bolt with Nut and Washers
146—¾" THRD stud with nut and washer

What is claimed as invention is:

1. A method comprising the steps of:

suctioning material by a vacuum unit;

during suctioning, collecting said suctioned material in a collection and discharge unit coupled to said vacuum unit; wherein said collecting includes the steps of collecting said suctioned material in a primary collection tank which is vertically stacked above a discharge tank, and directing an amount of said suctioned material through said primary collection tank to and through said discharge tank;

collecting an overflow portion of said suctioned material in a reserve collection tank when said suctioned material exceeds capacity of said primary collection tank;

channeling a suctioning force through said primary collection tank and said reserve collection tank of said collection and discharge unit to said vacuum unit; and during suctioning, discharging automatically said amount of said suctioned material from said collection and discharge unit.

2. The method of claim 1, wherein the step of directing said amount of said suctioned material further includes the step of:

directing said amount of said suctioned material to an opening in said discharge tank.

3. The method of claim 2, wherein said amount of said suctioned material is directed to said opening in said discharge tank by a sloped floor.

4. The method of claim 1, wherein the step of directing said amount of said suctioned material further includes flowing said amount of said suctioned material via gravity to said discharge tank.

5. The method of claim 1, further comprising the steps of:
transporting said collection and discharge unit; and
positioning, or re-positioning, said collection and discharge unit on top of an oil-field platform or at an industrial site.

6. The method of claim 1, wherein said suctioned material includes one of spilled fluid, drilling fluid and other material.

7. A method comprising the steps of:
suctioning material by a vacuum unit;
during suctioning, collecting said suctioned material in a collection and discharge unit coupled to said vacuum unit; wherein said collecting comprises the steps of collecting said suctioned material in a primary collection tank which is vertically stacked above a discharge tank, and directing a first amount of said suctioned material through said primary collection tank to and through said discharge tank;
during suctioning, discharging automatically said first amount of said suctioned material from said collection and discharge unit; wherein said discharging comprises the steps of sealing said discharge tank from said primary collection tank of said collection and discharge unit; and delivering pressurized air to said discharge tank to effectuate a force out of said first amount of said suctioned material through a discharge port of said collection and discharge unit.

8. The method of claim 7, wherein said step of directing said first amount of said suctioned material further includes the step of:
directing said first amount of said suctioned material to an opening in said discharge tank.

9. The method of claim 8, wherein said first amount of said suctioned material is directed to said opening in said discharge tank by a sloped floor.

10. The method of claim 7, wherein the step of directing said first amount of said suctioned material further includes flowing said first amount of said suctioned material via gravity to said discharge tank.

11. The method of claim 7, wherein after effectuating said force out of said first amount of said suctioned material, said discharge tank is unsealed from said primary collection tank to allow a directing of a second amount of said suctioned material through said primary collection tank and into said discharge tank.

12. The method of claim 7, wherein said discharge tank cycles between being sealed from said primary collection tank, resulting in said force out of said first amount of said suctioned material, and being unsealed from said primary collection tank, resulting in said directing of a second amount of said suctioned material through said primary collection tank into said discharge tank.

13. The method of claim 12 wherein said discharge collection tank comprises a plunger moveable from a non-discharging position to a discharging position.

14. The method of claim 13 wherein said plunger, when in said discharging position, seals said discharge tank from said primary collection tank and allows said air pressure to increase in said discharge tank to effectuate said force out of said first amount of said suctioned material.

15. The method of claim 14 wherein said plunger, when in said non-discharging position, unseals said discharge tank from said primary collection tank to allow said directing of said second amount of said suctioned material through said primary collection tank into said discharge tank.

16. The method of claim 13 wherein said plunger, when in said non-discharging position, unseals said discharge tank from said primary collection tank to allow said directing of said second amount of said suctioned material through said primary collection tank into said discharge tank.

17. The method of claim 7, further comprising the steps of:
transporting said collection and discharge unit; and
positioning, or re-positioning, said collection and discharge unit on top of an oilfield platform or at an industrial site.

18. The method of claim 7, wherein said suctioned material includes one of spilled fluid, drilling fluid and other material.

* * * * *